US010759174B2

(12) United States Patent
Toya

(10) Patent No.: US 10,759,174 B2
(45) Date of Patent: Sep. 1, 2020

(54) LIQUID EJECTING APPARATUS

(71) Applicant: SEIKO EPSON CORPORATION, Tokyo (JP)

(72) Inventor: Akihiro Toya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/161,282

(22) Filed: Oct. 16, 2018

(65) Prior Publication Data

US 2019/0118539 A1 Apr. 25, 2019

(30) Foreign Application Priority Data

Oct. 20, 2017 (JP) ..... 2017-203534
Nov. 2, 2017 (JP) ..... 2017-212825
Mar. 22, 2018 (JP) ..... 2018-054308

(51) Int. Cl.
*B41J 2/17* (2006.01)
*B41J 2/175* (2006.01)
(Continued)

(52) U.S. Cl.
CPC ..... *B41J 2/1721* (2013.01); *B41J 2/1752* (2013.01); *B41J 2/17523* (2013.01); *B41J 29/02* (2013.01);
(Continued)

(58) Field of Classification Search
CPC . B41J 2/1721; B41J 2/1714; B41J 2/17; B41J 2/17503; B41J 2/17509;
(Continued)

(56) References Cited

U.S. PATENT DOCUMENTS 6,227,661 B1 * 5/2001 Hayakawa ..... B41J 2/16523 347/86
6,267,475 B1 * 7/2001 Lee ..... B41J 2/1752 347/86
(Continued)

FOREIGN PATENT DOCUMENTS

JP 09-24618 A 1/1997
JP 10-305597 A 11/1998
(Continued)

OTHER PUBLICATIONS

Hagiwara, Machine Translation of JP 2008-044256 A (Year: 2008).*

*Primary Examiner* — Scott A Richmond
(74) *Attorney, Agent, or Firm* — Workman Nydegger

(57) ABSTRACT

A liquid ejecting apparatus includes a liquid ejecting head and a mounting unit. The liquid ejecting head is able to eject liquid. A plurality of liquid containers containing the liquid to be supplied to the liquid ejecting head mounted so as to overlap in an up-down direction. The mounting unit includes a separator and an electrical member. The separator separates, in the up-down direction, a space where the plurality of liquid containers are mounted. The electrical member allows electricity to flow therethrough. The separator has a through portion that penetrates through the separator in the up-down direction. The through portion is positioned such that, when seen in the up-down direction, an edge portion of the through portion does not overlap with the electrical member positioned below the through portion.

9 Claims, 16 Drawing Sheets

(51) Int. Cl.
*B41J 29/02* (2006.01)
*B41J 29/13* (2006.01)

(52) U.S. Cl.
CPC ..... *B41J 29/13* (2013.01); *B41J 2002/1742* (2013.01)

(58) Field of Classification Search
CPC .... B41J 2/1752; B41J 2/17526; B41J 2/1753; B41J 2/185; B41J 29/13; B41J 29/02; B41J 2002/1856; B41J 2002/1728; B41J 2002/1742; B41J 2002/1735
See application file for complete search history.

(56) References Cited

U.S. PATENT DOCUMENTS

| | | | | |
|---|---|---|---|---|
| 8,864,291 | B2 * | 10/2014 | Urabe | B41J 2/1752 347/86 |
| 2005/0185036 | A1 * | 8/2005 | Seino | B41J 2/1752 347/86 |
| 2008/0043074 | A1 * | 2/2008 | Hagiwara | B41J 2/17553 347/85 |
| 2015/0328895 | A1 * | 11/2015 | Kudo | B41J 2/14274 347/54 |
| 2017/0106687 | A1 * | 4/2017 | Ono | B41J 2/16585 |

FOREIGN PATENT DOCUMENTS

| | | | |
|---|---|---|---|
| JP | 2008-044256 | A | 2/2008 |
| JP | 2008044256 | A * | 2/2008 |

* cited by examiner

LIQUID EJECTING APPARATUS

BACKGROUND

1. Technical Field

The present invention relates to a liquid ejecting apparatus such as, for example, an ink jet printer.

2. Related Art

Examples of a liquid ejecting apparatus include a recording apparatus described in JP-A-2008-44256. This recording apparatus includes an ink-cartridge mounting unit in which a plurality of ink cartridges serving as liquid containers containing liquid are mounted. The ink cartridges mounted in the ink-cartridge mounting unit are stacked in the up-down direction. In order to collect the liquid when leakage of the liquid occurs, the ink-cartridge mounting unit has an opening. The liquid having leaked drops toward the bottom of the ink-cartridge mounting unit through this opening.

In the recording apparatus described in JP-A-2008-44256, when the liquid having leaked drops, the liquid may adhere to members included in the recording apparatus. In such a recording apparatus, adhering of the liquid to some members may cause failures.

SUMMARY

An advantage of some aspects of the invention is to provide a liquid ejecting apparatus with which the likelihood of failures occurring due to liquid having leaked can be reduced.

A liquid ejecting apparatus includes a liquid ejecting head and a mounting unit. The liquid ejecting head is able to eject liquid. A plurality of liquid containers containing the liquid to be supplied to the liquid ejecting head are mounted in the mounting unit so as to overlap in an up-down direction. The mounting unit includes a separator and an electrical member. The separator separates, in the up-down direction, a space where the plurality of liquid containers are mounted. The electrical member allows electricity to flow therethrough. The separator has a through portion that penetrates through the separator in the up-down direction. The through portion is positioned such that, when seen in the up-down direction, an edge portion of the through portion does not overlap with the electrical member positioned below the through portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of a liquid ejecting apparatus will be described below with reference to the drawings. The liquid ejecting apparatus is, for example, an ink jet printer that prints an image such as a character or a photograph on a medium such as a sheet of paper by ejecting ink as an example of liquid.

First Embodiment

Figure 1:
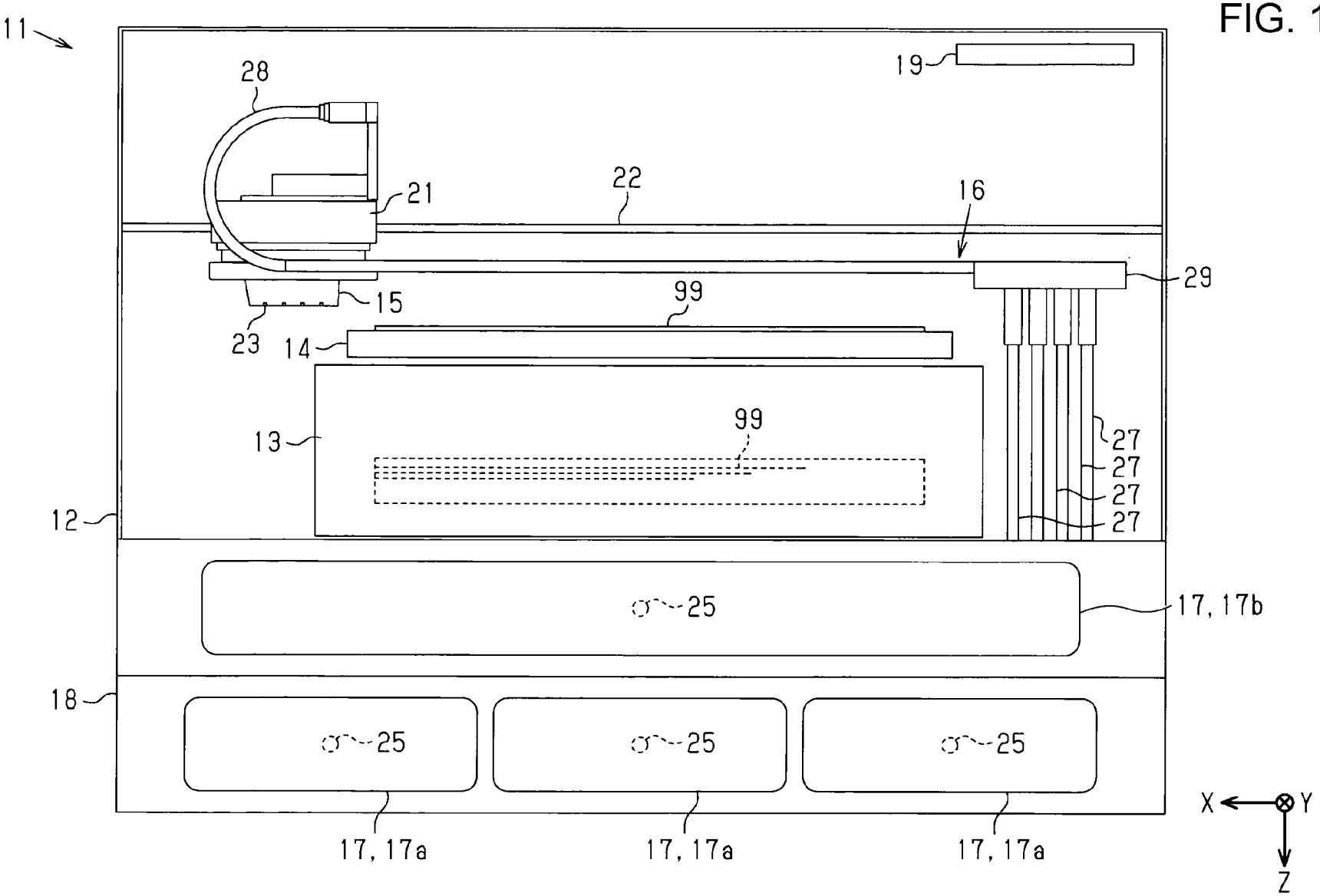
FIG. 1 is a front view schematically illustrating a liquid ejecting apparatus according to a first embodiment.

As illustrated in FIG. 1, a liquid ejecting apparatus 11 includes a housing 12, a cassette 13 that can contain media 99, and a support table 14 that can support the media 99. The liquid ejecting apparatus 11 also includes a liquid ejecting head 15 that can eject liquid, a supply channel 16 for supplying the liquid to the liquid ejecting head 15, a mounting unit 18 in which liquid containers 17 are removably mounted, and a controller 19. The cassette 13, the support table 14, the liquid ejecting head 15, the supply channel 16, the mounting unit 18, and the controller 19 are disposed in the housing 12. The controller 19 collectively controls the liquid ejecting apparatus 11.

The cassette 13 is removably mounted in the housing 12. The cassette 13 is mounted by being moved in the depth direction Y and removed from the mounting unit 18 by being moved in the opposite direction to the depth direction Y. The depth direction Y refers to a direction directed, for example, from a front surface to a rear surface of the liquid ejecting apparatus 11. Thus, the cassette 13 according to the present embodiment is mounted through/removed from the front surface of the liquid ejecting apparatus 11. The media 99 contained in the cassette 13 are transported in the housing 12 by rollers (not illustrated) disposed in the housing 12.

The support table 14 is positioned above the cassette 13. The support table 14 supports, for example, the each of the media 99 transported from the cassette 13. The liquid ejecting head 15 is positioned above the support table 14. The liquid ejecting head 15 is held by a carriage 21 that reciprocates in the width direction X in the housing 12. The width direction X is different from the depth direction Y or the direction of gravity Z. The carriage 21 is supported by a guide shaft 22 extending in the width direction X in the housing 12. The guide shaft 22 guides the movement of the carriage 21.

The liquid ejecting head 15 includes nozzles 23 from which the liquid can be ejected. The liquid ejecting head 15 ejects the liquid from the nozzles 23 to the medium 99 supported by the support table 14 when the liquid ejecting head 15 is moved together with the carriage 21. In this way, the liquid ejecting head 15 performs printing on the medium 99.

The mounting unit 18 is positioned below the cassette 13. The liquid containers 17 can contain the liquid. The mounting unit 18 includes connecting portions 25 connectable to the liquid containers 17 mounted in the mounting unit 18. The liquid contained in the liquid containers 17 can be supplied through the connecting portions 25. That is, the liquid can be supplied from the liquid containers 17 to the liquid ejecting head 15 through the connecting portions 25.

The liquid containers 17 contain the liquid to be supplied to the liquid ejecting head 15. The liquid containers 17 are mounted in the mounting unit 18 by being moved in the depth direction Y and removed from the mounting unit 18 by being moved in the opposite direction to the depth direction Y. The liquid containers 17 according to the present embodiment are, as is the case with the cassette 13, mounted through/removed from the front surface of the liquid ejecting apparatus 11.

A plurality of the liquid containers 17 can be mounted in the mounting unit 18 so as to overlap in the up-down direction. The mounting unit 18 according to the present embodiment allows the plurality of liquid containers 17 to be mounted therein on two stages, that is, on an upper stage and a lower stage. The mounting unit 18 may allow the plurality of liquid containers 17 to be mounted therein on three or more stages.

Three liquid containers 17 are arranged in the width direction X on the lower stage of the mounting unit 18. One of the liquid containers 17 having a larger capacity than three other liquid containers 17 is mounted on the upper stage of the mounting unit 18. This large-capacity liquid container 17 has a larger length than that of the other liquid containers 17 in the width direction X.

The plurality of liquid containers 17 respectively contain different types of the liquid. According to the present embodiment, the large-capacity liquid container 17 contains black ink that is used frequently. The other three liquid containers 17 contain, for example, color ink such as cyan ink, magenta ink, and yellow ink. According to the present embodiment, the liquid containers 17 positioned on the lower stage of the mounting unit 18 may be referred to as "lower liquid containers 17*a*", and the liquid container 17 positioned on the upper stage of the mounting unit 18 may be referred to as "upper liquid container 17*b*". That is, in the mounting unit 18, the lower liquid containers 17*a* and the upper liquid container 17*b* are arranged in the direction of gravity Z.

The supply channel 16 allows the liquid to be supplied therethrough from the liquid containers 17 mounted in the mounting unit 18 to the liquid ejecting head 15. The supply channel 16 includes first channel forming members 27, second channel forming members 28, and a coupling member 29 that connects the first channel forming members 27 and the respective second channel forming members 28 to one another.

The first channel forming members 27 connect the mounting unit 18 and the coupling member 29 to each another. The second channel forming members 28 connect the coupling member 29 and the liquid ejecting head 15 to each other. The first and second channel forming members 27, 28 are, for example, bendable tubes. The numbers of a plurality of the first channel forming members 27 and a plurality of the second channel forming members 28 to be provided correspond to the number of the liquid containers 17 able to be mounted in the mounting unit 18. The coupling member 29 is connected to the plurality of first channel forming members 27 and the plurality of second channel forming members 28.

Figure 2:
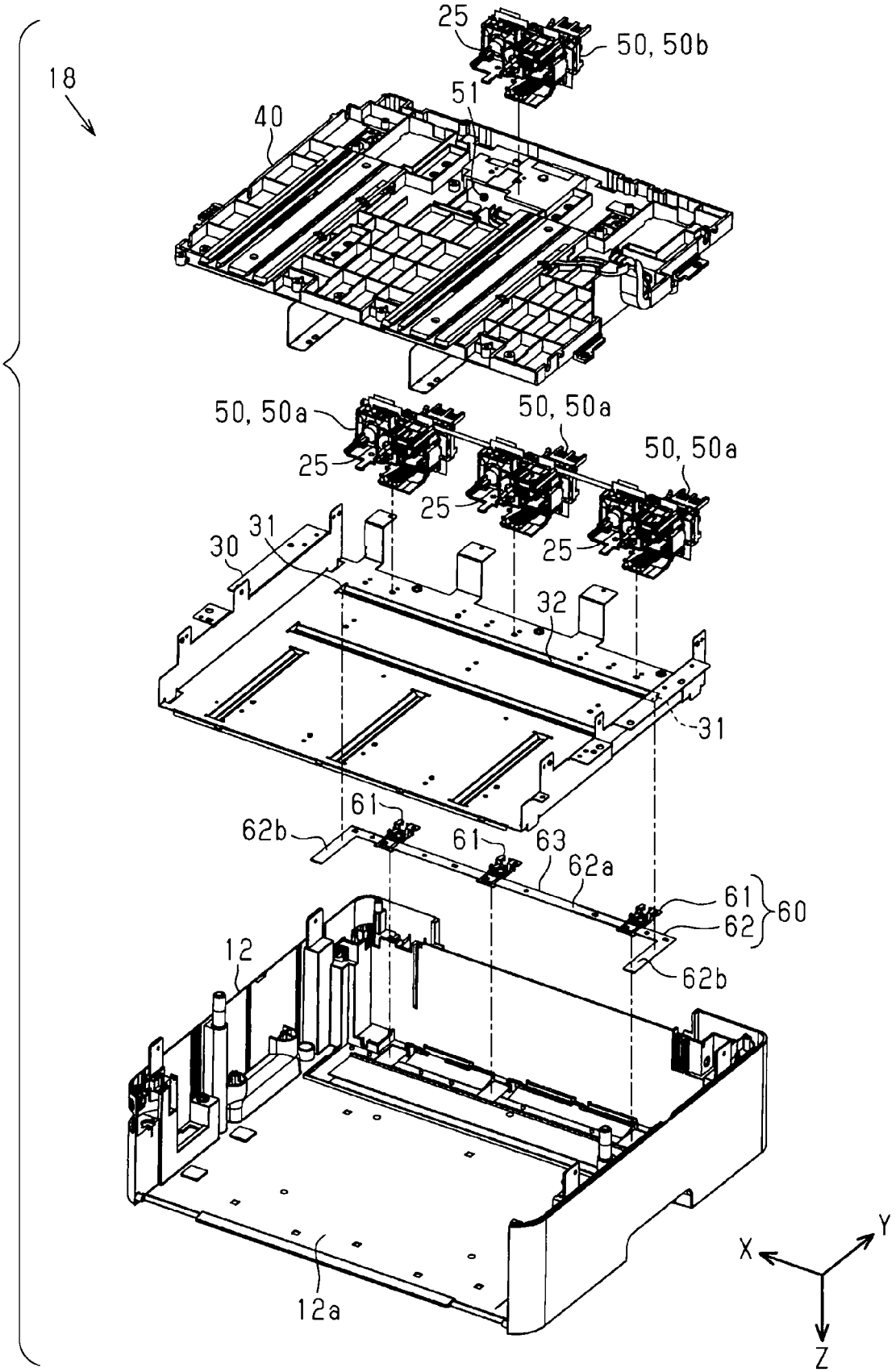
FIG. 2 is an exploded perspective view of a mounting unit.

As illustrated in FIG. 2, the mounting unit 18 includes a frame member 30, a separator 40, and connecting units 50. The frame member 30 is formed of, for example, a metal sheet and mounted on an inner bottom portion of the housing 12. Since the frame member 30 is formed of a metal sheet, the rigidity of the housing 12 is improved. The frame member 30 supports the liquid containers 17 mounted in the mounting unit 18. The liquid containers 17 mounted in the mounting unit 18 are positioned above the frame member 30.

The separator 40 is a plate-shape member formed of, for example, resin. Since the separator 40 is formed of resin, the weight of the mounting unit 18 is reduced. The separator 40 is mounted on the frame member 30. A space in which the liquid containers 17 are mounted is separated in the up-down direction by mounting the separator 40 on the frame member 30. That is, in the mounting unit 18, a space below the separator 40 allows the lower liquid containers 17*a* to be mounted therein. Thus, the lower liquid containers 17*a* are disposed on the frame member 30 such that the lower liquid containers 17*a* are interposed between the frame member 30 and the separator 40. In the mounting unit 18, a space above the separator 40 allows the upper liquid container 17*b* to be mounted therein. The upper-stage liquid container 17*b* is disposed on the separator 40.

The separator 40 separates, in the up-down direction, the space where the plurality of liquid containers 17 mounted in the mounting unit 18 are mounted. When the mounting unit 18 allows the liquid containers 17 to be separately mounted on three or more stages, a plurality of separators 40 are provided.

The connecting units 50 are connected to the liquid containers 17 mounted in the mounting unit 18. The connecting portions 25 are parts of elements of the connecting units 50. The connecting units 50 are disposed near the rear portion in the depth direction Y.

The number of the connecting units 50 to be provided corresponds to the number of the liquid containers 17 able to be mounted. The mounting unit 18 according the present embodiment includes four connecting units 50. Three of the connecting units 50 are mounted on the frame member 30 and one of the connecting units 50 is mounted on the separator 40. According to the present embodiment, the connecting units 50 connected to the lower liquid containers 17*a* may be referred to as "lower connecting units 50*a*", and the connecting unit 50 connected to the upper liquid container 17*b* may be referred to as "upper connecting unit 50*b*". The lower connecting units 50*a* mounted on the frame member 30 are arranged in the width direction X. The upper connecting unit 50*b* is mounted at a central position of the separator 40 in the width direction X.

Each of the connecting units 50 is connected to one end of a corresponding one of the first channel forming members 27. Thus, when the liquid container 17 is connected to a corresponding one of the connecting portion 25, the liquid contained in the liquid container 17 flows into the supply channel 16 through the connecting units 50.

There may be leakage of the liquid through joints where the members are connected to one another between the liquid containers 17 mounted in the mounting unit 18 and the liquid ejecting head 15. For example, the connecting portions 25 are the joints where the liquid containers 17 are connected to the respective connecting units 50. The liquid is highly likely to leak through the connecting portions 25 while the liquid containers 17 are being mounted in/removed from the mounting unit 18.

The supply channel 16, which includes a plurality of members, has the joints. For example, in the supply channel 16, portions where the first channel forming members 27 and the coupling member 29 are connected to one another and portions where the coupling member 29 and the second channel forming members 28 are connected to one another are the joints.

The connecting units 50, which each include a plurality of members, have the joints as is the case with the supply channel 16. Each of the connecting units 50 includes, for example, a check valve, a diaphragm pump, a buffer, and so forth in addition to the connecting portion 25. The check valve suppresses flowing of the liquid from the connecting unit 50 to the liquid container 17. The diaphragm pump sucks and discharges the liquid contained in the liquid containers 17. The buffer stores the liquid supplied from the liquid container 17. Portions where these members are connected to one another are the joints in the connecting unit 50.

When the liquid leaks through such joints, the liquid flows downward in the housing 12. In order to address this, the liquid ejecting apparatus 11 includes in the inner bottom portion of the housing 12 a detection unit 60 that detects the liquid having leaked.

The detection unit 60 is provided on a bottom wall 12*a* of the housing 12 below the mounting unit 18. The detection unit 60 is disposed near the rear portion in the depth direction Y on the bottom wall 12*a*. The detection unit 60 includes detectors 61 and a guide portion 62. Each of the detectors 61 is, for example, a sensor and electrically connected to the controller 19. When the liquid adheres to the detector 61, the liquid is detected by the detector 61. Upon detection of the liquid, the detector 61 transmits a signal to the controller 19. Thus, the controller 19 recognizes the leakage of the liquid.

The guide portion 62 guides the liquid having dropped to the bottom wall 12*a* of the housing 12 to the detectors 61. The guide portion 62 has a detection portion 62*a* extending in the width direction X and extended portions 62*b* extending from both ends of the detection portion 62*a* in the opposite direction to the depth direction Y. The detectors 61 are disposed so as to be in contact with the detection portion 62*a* in the guide portion 62. Thus, the detection portion 62*a* is the target of the detection performed by the detectors 61. According to the present embodiment, a plurality of the detectors 61 are provided such that the detectors 61 are spaced from one another along the detection portion 62*a*.

The guide portion 62 includes an absorbing member 63 that absorbs the liquid. The absorbing member 63 has, for example, a belt shape. When the extended portions 62*b* absorb the liquid, the absorbing member 63 guides, due to the absorbing force thereof, the liquid absorbed by the extended portions 62*b* from the extended portions 62*b* to the detection portion 62*a*. When the liquid having been absorbed by the extended portions 62*b* permeates the detection portion 62*a*, the detectors 61 detect the liquid. In this way, the detectors 61 detect the liquid having leaked.

The frame member 30 has holes 31 through which the liquid having leaked drops. The liquid having leaked to the frame member 30 drops to the bottom wall 12*a* of the housing 12 through the holes 31 and is detected by the detection unit 60.

The frame member 30 has a collection groove 32 through which the liquid having leaked is collected. The collection groove 32 extends in the width direction X so that the liquid leaked to the frame member 30 is collected. The holes 31 are continuous with both ends of the collection groove 32 of the frame member 30. Thus, the liquid collected through the collection groove 32 efficiently drops to the bottom wall 12*a* of the housing 12 through the holes 31.

It is preferable that the holes 31 be superposed on part of the guide portion 62 when seen in the up-down direction. According to the present embodiment, the extended portions 62*b* of the guide portion 62 are positioned immediately below the holes 31. In this way, the guide portion 62 guides the liquid having dropped from the holes 31 to the detectors 61. Thus, the liquid having leaked can be quickly detected.

The separator 40 has a through portion 41 for dropping of the liquid having leaked. The through portion 41 is, for example, a hole that penetrates through the separator 40 in the up-down direction. That is, the through portion 41 allows the space where the lower liquid containers 17*a* are mounted and the space where the upper liquid container 17*b* is mounted to communicate therethrough. The liquid having leaked to the separator 40 drops to the frame member 30 or the bottom wall 12*a* of the housing 12 through this through portion 41. The liquid having dropped to the frame member 30 drops to the bottom wall 12*a* of the housing 12 through the holes 31 of the frame member 30.

Figure 3:
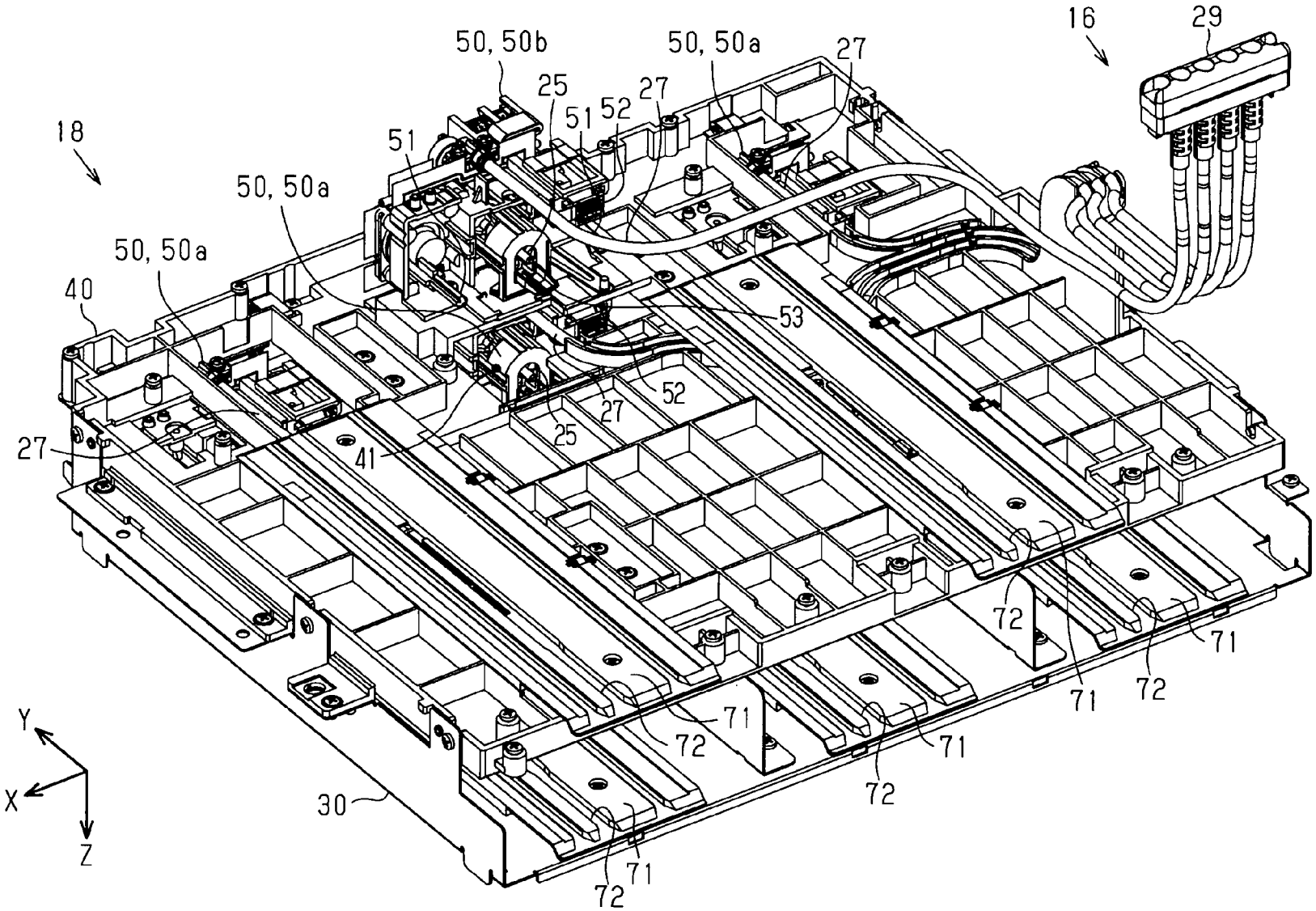
FIG. 3 is a perspective view of the mounting unit.
Figure 4:
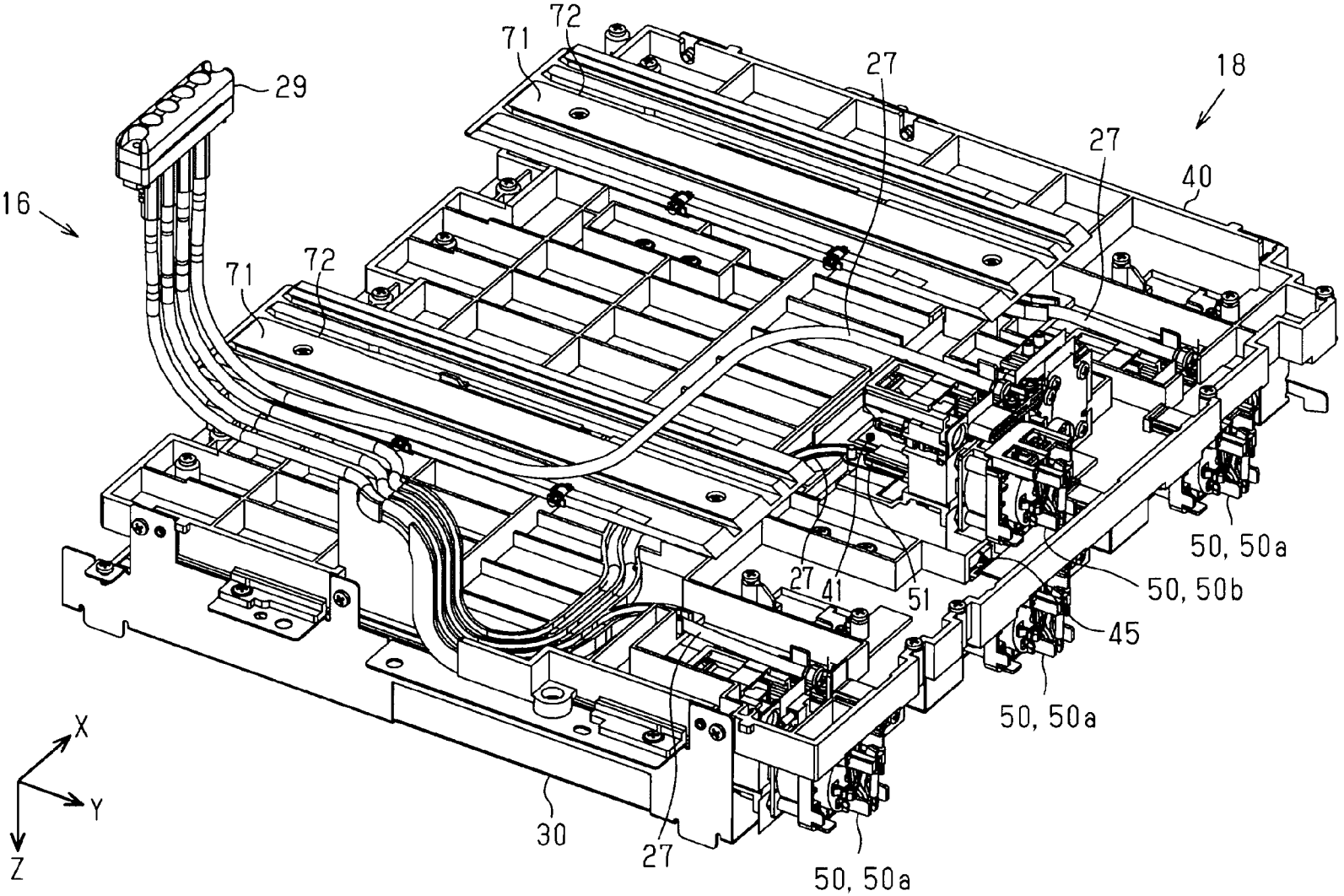
FIG. 4 is a perspective view of the mounting unit when seen at a different angle from an angle at which the mounting unit is seen in FIG. 3.

As illustrated in FIGS. 3 and 4, the mounting unit 18 includes guide plates 71 that guide movements of the liquid containers 17 during mounting of the liquid containers 17. The guide plates 71 are mounted on the frame member 30 and the separator 40. Each of the guide plates 71 has a plurality of guide grooves 72 extending in the depth direction Y, thereby the movements of the liquid containers 17 are guided during mounting/removing of the liquid containers 17.

The position of the through portion 41 corresponds to the position of the upper connecting unit 50*b*. The through portion 41 is disposed in front of the upper connecting unit 50*b* in the depth direction Y. One of the first channel forming members 27 connected to one of three lower connecting units 50*a* at the center in the width direction X extends so as to pass through the through portion 41 of the separator 40. That is, the through portion 41 according to the present embodiment also serves as a passage for routing the supply channel 16 in the housing 12.

Figure 5:
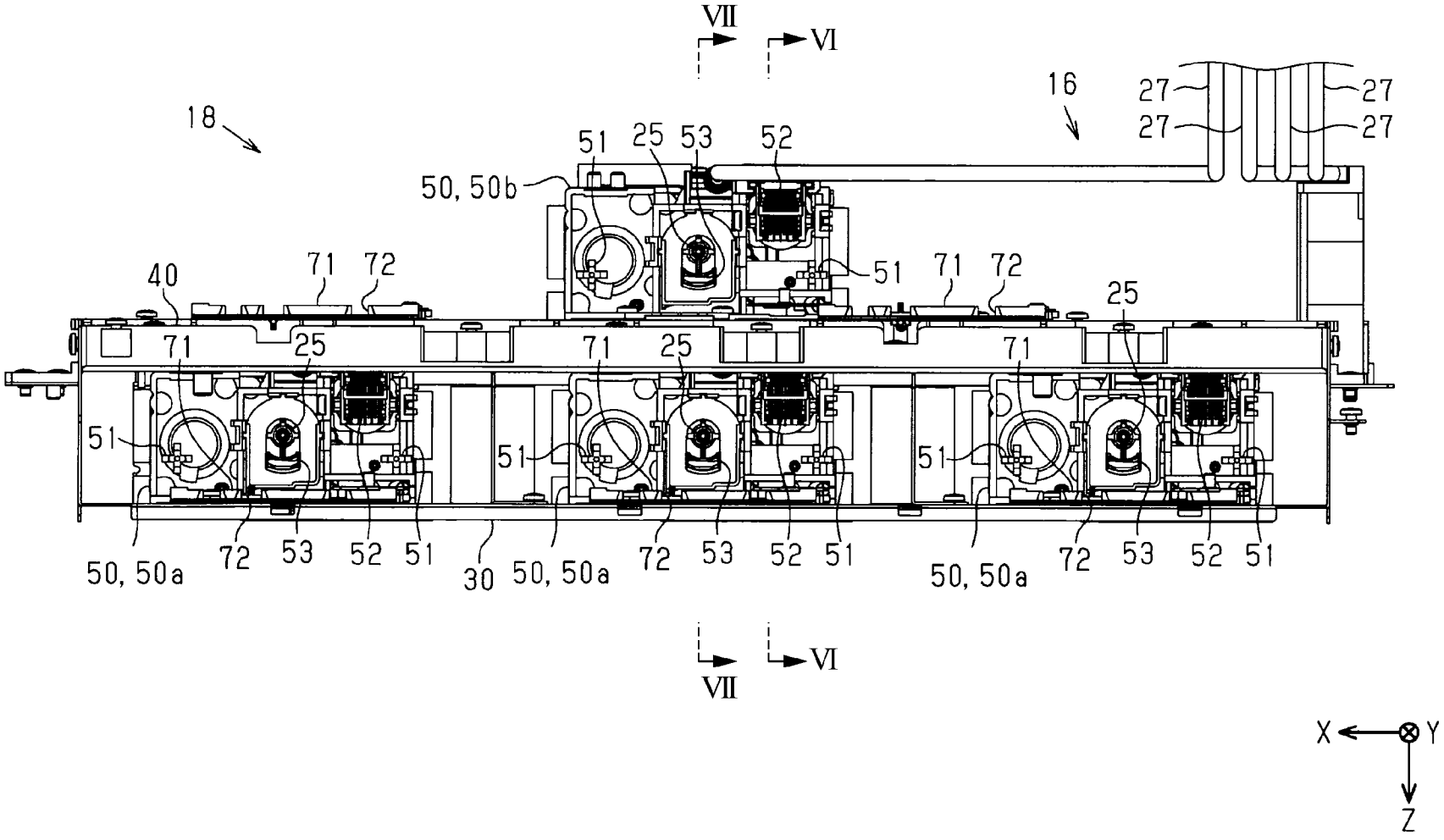
FIG. 5 is a front view of the mounting unit.

As illustrated in FIG. 5, the connecting units 50 each include the connecting portion 25, guide rods 51, and a connecting terminal 52. The connecting portion 25 is, for example, a supply needle inserted into the liquid container 17 during mounting of the liquid container 17. The connecting portion 25 extends in the opposite direction to the depth direction Y.

As is the case with the connecting portion 25, the guide rods 51 extend in the opposite direction to the depth direction Y. Two guide rods 51 are provided in each of the connecting units 50 such that the connecting portion 25 is interposed between two guide rods 51 in the width direction X. During mounting of the liquid container 17, the guide rods 51 are inserted into the liquid container 17, thereby the movement of the liquid container 17 in the depth direction Y is guided. The liquid container 17 is stably connected to the connecting portion 25 by being guided by the guide rods 51.

The connecting terminal 52 is disposed above the guide rods 51 and connected to the controller 19. When the liquid container 17 is mounted, the connecting terminal 52 is electrically connected to a circuit substrate included in the liquid container 17. Information such as the type, the remaining amount, and the date of manufacture of the liquid contained in the liquid container 17 is recorded in the circuit substrate of the liquid container 17. When the circuit substrate is connected to the connecting terminal 52, the controller 19 reads the information from/writes the information to the circuit substrate. That is, the connecting terminal 52 exemplifies one of electrical members that allow electricity to flow therethrough.

The mounting unit 18 may include a liquid-remaining-amount substrate in which the remaining amount of the liquid in the buffer of the connecting unit 50 is recorded. In this case, the controller 19 reads the information from/writes the information to the liquid-remaining-amount substrate so as to control the remaining amount of the liquid in the buffer. That is, the liquid-remaining-amount substrate exemplifies one of the electrical members that allow electricity to flow therethrough.

The electrical members allow electricity to path therethrough when the mounting unit 18 functions. Thus, the electrical members include other substrates, motors, sensors, and so forth in addition to the connecting terminal 52 and the liquid-remaining-amount substrate.

When leakage of the liquid occurs in the housing 12, the liquid may adhere to the connecting terminals 52 or other electrical members, resulting in failures such as a contact failure and a failure in supplying power. Accordingly, it is not preferable that the liquid having leaked adhere to the connecting terminals 52 or the other electrical members. That is, it is preferable that the through portion 41 of the separator 40 be disposed so as not to allow the liquid to drop to the connecting terminals 52 positioned below the through portion 41.

Figure 6:
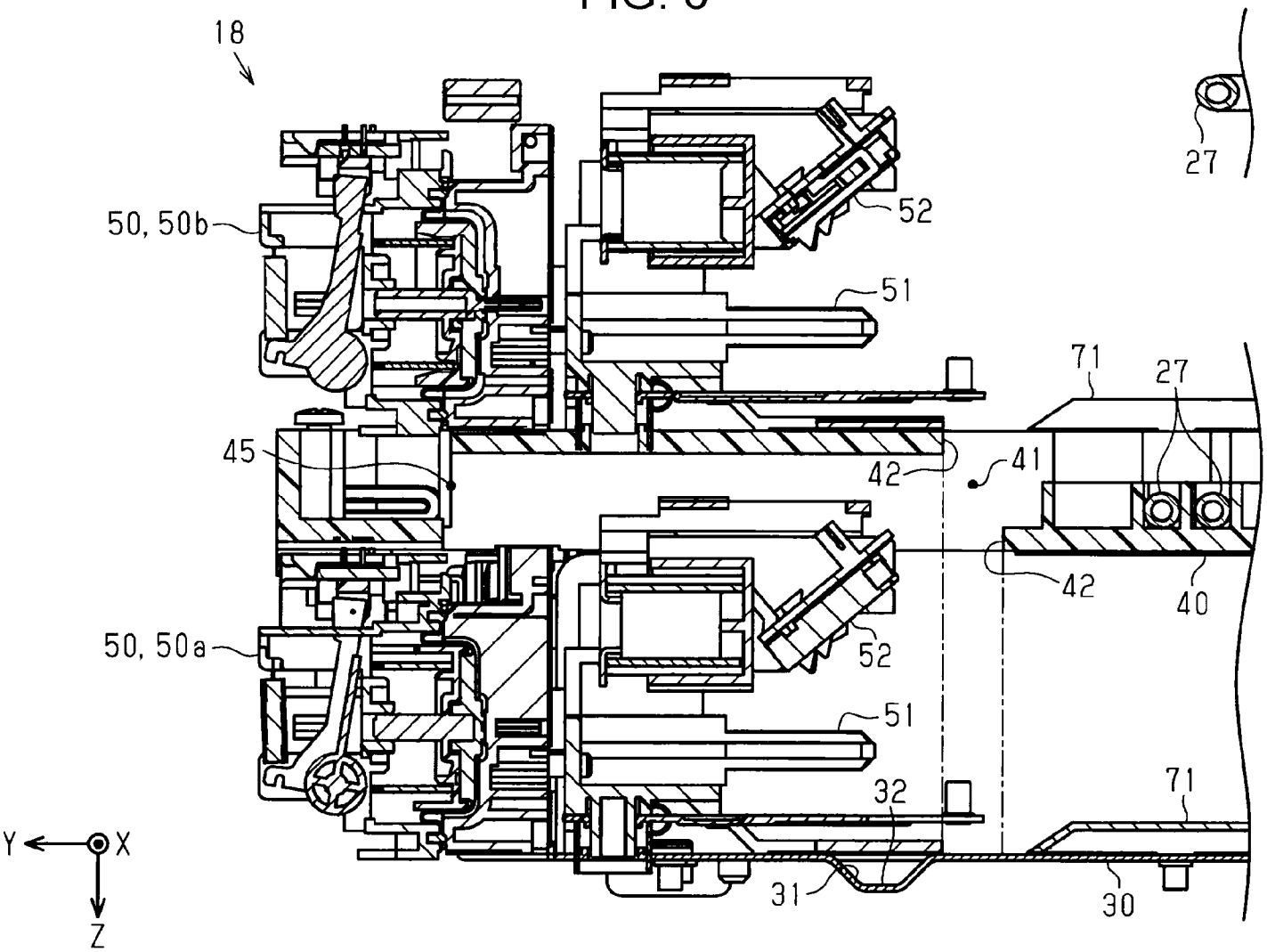
FIG. 6 is a sectional view taken along line VI-VI in FIG. 5.

As illustrated in FIG. 6, the through portion 41 is positioned such that, when seen in the up-down direction, an edge portion 42 of the through portion 41 does not overlap with any of the connecting terminals 52 positioned below the through portion 41. That is, the through portion 41 is positioned such that the edge portion 42 of the through portion 41 does not overlap with any of the connecting terminals 52 of the lower connecting units 50*a* when seen in the up-down direction.

When the liquid leaks to the separator 40, the liquid drops so as to flow along the edge portion 42 of the through portion 41. Thus, by disposing the edge portion 42 of the through portion 41 at a different position from the position of any of the connecting terminals 52 of the lower connecting units 50*a* when seen in the direction of gravity Z, that is, the up-down direction, the likelihood of the liquid that drops through the through portion 41 adhering to any of the connecting terminals 52 of the lower connecting units 50*a* is reduced. The through portion 41 according to the present embodiment is positioned such that, when seen in the up-down direction, the through portion 41 does not overlap with any of the connecting terminals 52 positioned below the through portion 41.

Figure 7:
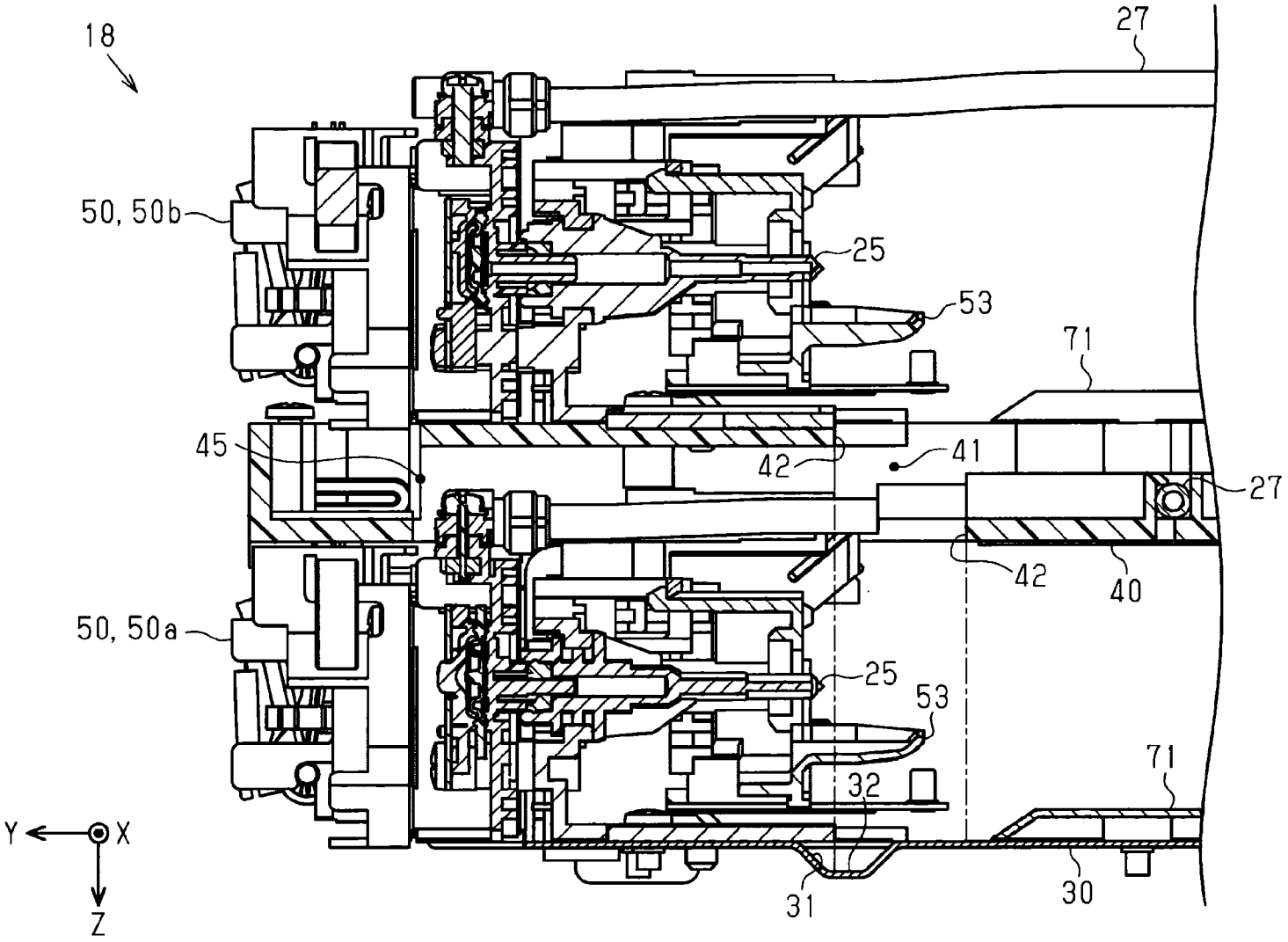
FIG. 7 is a sectional view taken along line VII-VII in FIG. 5.

As illustrated in FIG. 7, the through portion 41 is positioned such that, when seen in the up-down direction, the edge portion 42 of the through portion 41 does not overlap with any of the connecting portions 25 positioned below the through portion 41. That is, the through portion 41 is positioned such that the edge portion 42 of the through portion 41 does not overlap with any of the connecting portions 25 of the lower connecting units 50*a* when seen in the up-down direction. By disposing the edge portion 42 of the through portion 41 at a different position from the position of any of the connecting portions 25 of the lower connecting units 50*a* when seen in the direction of gravity Z, that is, the up-down direction, the likelihood of the liquid that drops through the through portion 41 adhering to any of the connecting portions 25 of the lower connecting units 50*a* is reduced. The through portion 41 according to the present embodiment is positioned such that, when seen in the up-down direction, the through portion 41 does not overlap with any of the connecting portions 25 positioned below the through portion 41.

Each of the connecting units 50 may include a receiving portion 53 positioned below the connecting portion 25. The receiving portion 53 receives the liquid leaking from the connecting portion 25. In this case, when the receiving portion 53 receives the liquid leaking from the connecting portion 25, this liquid flows along the receiving portion 53 and flows down toward the rear side in the depth direction Y. When the receiving portion 53 of the upper connecting unit 50*b* receives the liquid, this liquid flows down further to the rear side than the through portion 41 in the depth direction Y on the separator 40. After that, the liquid having leaked flows along the edge portion 42 on the rear side in the depth direction Y and drops from the through portion 41.

Next, operation and effects of the liquid ejecting apparatus 11 structured as above are be described.

1. When the liquid leaks from above the separator 40, this liquid flows down on the separator 40. The liquid leaking on the separator 40 drops through the through portion 41. At this time, the liquid drops along the edge portion 42 of the through portion 41. It is not preferable that, when the liquid drops, the liquid adhere to any of the connecting terminals (electrical members) 52 through which electricity flows. In this regard, according to the above-described embodiment, the edge portion 42 of the through portion 41 does not overlap with any of the connecting terminals (electrical members) 52 when seen in the up-down direction. This can reduce the likelihood of the liquid that drops from the through portion 41 adhering to any of the connecting terminals (electrical members) 52. Accordingly, the likelihood of failures occurring due to the liquid having leaked can be reduced.

2. The through portion 41 is positioned such that the through portion 41 does not overlap with any of the connecting terminals (electrical members) 52 when seen in the up-down direction. That is, when seen in the up-down direction, the through portion 41 is disposed at a different position from the position of any of the connecting terminals (electrical members) 52 disposed below the through portion 41. "This can reduce the likelihood of the liquid that drops from the through portion 41 adhering to any of the connecting terminals (electrical members) 52.

3. When the liquid containers 17 mounted in the mounting unit 18 are connected to the connecting portions 25, the liquid is supplied from the liquid containers 17 to the liquid ejecting head 15 through the connecting portions 25. In the mounting unit 18 in which the plurality of liquid containers 17 can be mounted, the plurality of different liquid containers 17 containing different types of the liquid may be mounted. In this case, when the liquid that drops from the through portion 41 adheres to any of the connecting portions 25 positioned below the through portion 41, different types of the liquid may be mixed with each other. In this regard, according to the above-described embodiment, the edge portion 42 of the through portion 41 does not overlap with any of the connecting portions 25 positioned below the through portion 41 when seen in the up-down direction. This can reduce the likelihood of the liquid that drops from the through portion 41 adhering to any of the connecting portions 25.

4. The through portion 41 is positioned such that, when seen in the up-down direction, the through portion 41 does not overlap with any of the connecting portions 25 positioned below the through portion 41. That is, when seen in the up-down direction, the through portion 41 is disposed at a different position from the positions of the connecting portions 25 disposed below the through portion 41. This can further reduce the likelihood of the liquid that drops from the through portion 41 adhering to any of the connecting portions 25.

5. The detection unit 60 is provided. The detection unit 60 is disposed below the mounting unit 18 and includes the detectors 61 that can detect adhering of the liquid. This allows the detectors 61 to detect the liquid having leaked. Accordingly, the user can be notified of leakage of the liquid.

6. The guide portion 62 includes the absorbing member 63 that can absorb the liquid. Thus, the liquid that drops from the through portion 41 is absorbed by the absorbing member 63, thereby the liquid is guided to the detectors 61. Accordingly, the liquid having leaked can be detected further quickly.

The above-described embodiment may be varied as in variations described below. The structures included in the above-described embodiment and structures included in the following variations may be arbitrarily combined, and the structures included in the following variations may be arbitrarily combined with each other.

Figure 8:
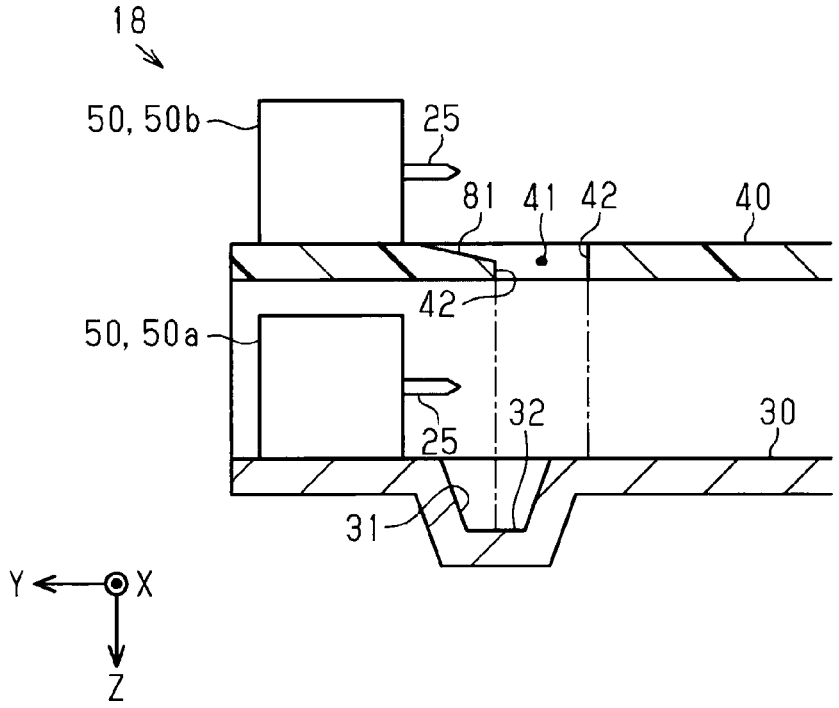
FIG. 8 is a schematic sectional view of a variation of the mounting unit.

As illustrated in FIG. 8, the separator 40 may have an inclined portion 81 downwardly inclined toward the through portion 41. According to this variation, the inclined portion 81 is disposed behind the through portion 41 in the depth direction Y. This structure allows the liquid leaking from the connecting portion 25 to effectively flow toward the through portion 41. The inclined portion 81 is continuous with the edge portion 42 of the through portion 41. The inclined portion 81 may be disposed in front of the through portion 41, or inclined portions 81 may be respectively disposed in front of and behind the through portion 41 in the depth direction Y. Furthermore, the inclined portion 81 may be adjacent to the through portion 41 in the width direction X.

According to this variation, the following effect can be obtained.

7. When the liquid leaks to the separator 40, this liquid flows along the inclined portion 81. Thus, the liquid having leaked can be guided to the through portion 41.

Figure 9:
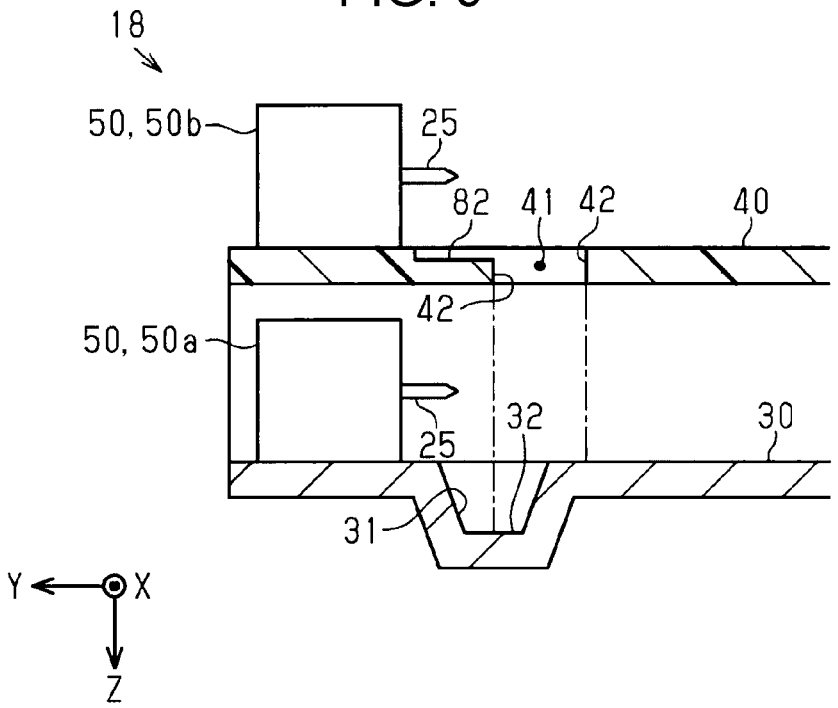
FIG. 9 is a schematic sectional view of a different variation of the mounting unit.

As illustrated in FIG. 9, the separator 40 may have a groove 82 extending toward the through portion 41. According to this variation, the groove 82 is disposed behind the through portion 41 in the depth direction Y. The groove 82 is continuous with the edge portion 42 of the through portion 41. When the liquid having leaked to the separator 40 flows into the groove 82, the liquid flows toward the through portion 41 due to a capillary force of the groove 82. This allows the liquid leaking from the connecting portion 25 to effectively flow toward the through portion 41. The groove 82 may be disposed in front of the through portion 41 in the depth direction Y. The groove 82 may be adjacent to the through portion 41 in the width direction X. A plurality of grooves 82 may be provided.

According to this variation, the following effect can be obtained.

8. When the liquid leaks to the separator 40, this liquid flows into the groove 82. Thus, the liquid can be guided to the through portion 41.

Figure 10:
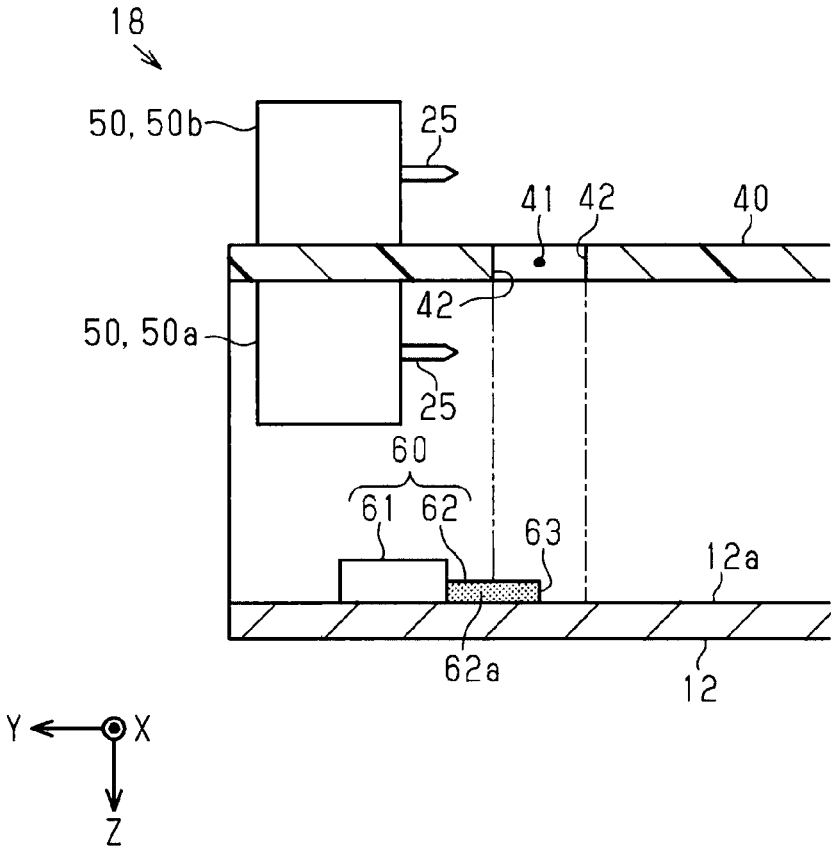
FIG. 10 is a schematic sectional view of a different variation from the variation illustrated in FIG. 8 or 9.

As illustrated in FIG. 10, the mounting unit 18 may be structured such that the liquid directly drops to the bottom wall 12*a* of the housing 12 through the through portion 41.

As illustrated in FIG. 10, it is preferable that the through portion 41 be positioned such that, when seen in the up-down direction, the edge portion 42 of the through portion 41 is superposed on part of the guide portion 62. That is, it is preferable that the detection unit 60 include the guide portion 62 that is in contact with the detectors 61 and positioned such that part of the guide portion 62 is, when seen in the up-down direction, superposed on the edge portion 42 of the through portion 41. With this structure, when the liquid drops from the through portion 41 to the bottom wall 12*a* of the housing 12, the liquid is guided to the detectors 61 through the guide portion 62. Accordingly, the liquid having leaked can be quickly detected.

According to this variation, the following effect can be obtained.

9. The liquid having dropped from the through portion 41 is guided to the detectors 61 by the guide portion 62. Thus, the liquid having leaked can be quickly detected.

The through portion 41 is not necessarily disposed in front of the upper connecting unit 50*b* in the depth direction Y. For example, as illustrated in FIGS. 4, 6, and 7, a through portion 45 may be disposed behind the upper connecting unit 50*b* in the depth direction Y. In this case, the through portion 41 may be provided or may be omitted. As is the case with the through portion 41, the through portion 45 is positioned such that an edge portion 42 of the through portion 45 does not overlap with any of the connecting terminals 52 of the lower connecting units 50*a* when seen in the up-down direction. An inclined portion 81 or a groove 82 may be provided also for the through portion 45.

The through portion 41 may be a cut formed by cutting part of the separator 40.

The plurality of liquid containers 17 mounted in the mounting unit 18 may contain the liquid of the same type.

The number of the liquid containers 17 mountable in the mounting unit 18 may be five or larger or three or smaller.

The cassette 13 may be disposed below the mounting unit 18.

The large-capacity liquid container 17 may be mounted on the lower stage in the mounting unit 18. Alternatively, the capacity of the liquid containers 17 mounted in the mounting unit 18 may be the same. Two or more of the liquid containers 17 may be mounted on the upper stage in the mounting unit 18. The number and the layout of the liquid containers 17 mounted in the mounting unit 18 can be changed as desired.

The detection unit 60 may include only a single detector 61.

The guide portion 62 may have a groove having the detection portion 62*a* and the extended portions 62*b* therein. In this case, the guide portion 62 does not necessarily include the absorbing member 63. When the guide portion 62 includes the absorbing member 63 and the groove, the liquid having leaked can be more quickly detected by fitting the absorbing member 63 into the groove.

The absorbing member 63 may have a mesh shape and intersections of the mesh may be used as the detection portion 62*a*.

The absorbing member 63 may have a cross shape and an intersection of the cross shape may be used as the detection portion 62*a*.

The shape of the extended portions 62*b* may be changed so that the level in height of the extended portions 62*b* of the absorbing member 63 is changed. This allows the extended portions 62*b* to be desirably disposed near positions where the liquid is likely to leak.

The detection portion 62*a* and the extended portions 62*b* may be, for example, integrally formed of a porous material or formed by connecting the extended portions 62*b* that are separate members and formed of a thread or a cord to the detection portion 62*a* formed of, for example, nonwoven fabric.

The liquid ejecting head 15 may be a line scan head elongated in the width direction X.

The liquid to be ejected by the liquid ejecting head 15 is not limited to the ink and may be a material in a liquid state or the like formed by, for example, dispersing a particle of a functional material in liquid or mixing a particle of a functional material with liquid. For example, the liquid ejecting head 15 may eject a material in a liquid state containing a material such as an electrode material or colorant (material of pixels) dispersed or dissolved therein used for the manufacture or the like of liquid crystal displays, electroluminescent (EL) displays, or field emission displays.

The medium 99 is not limited to a sheet of paper and may be a plastic film, a thin plate, or the like. Alternatively, the medium 99 may be fabric used for, for example, a textile printing device. Alternatively, the medium 99 may be clothing or the like having an arbitrary shape such as T-shirt or a three-dimensional object having an arbitrary shape such as tableware or a writing material.

Second Embodiment

Figure 11:
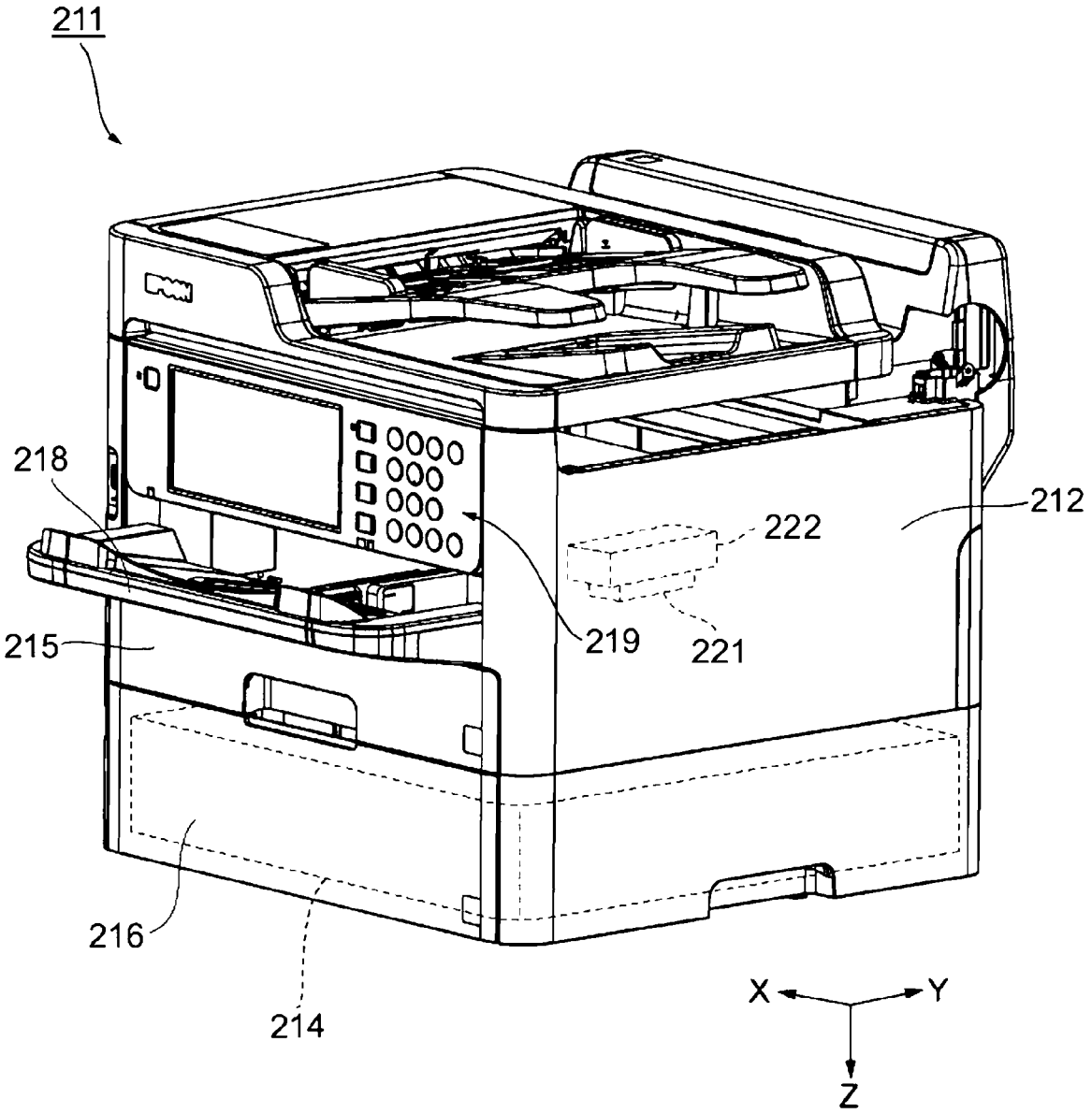
FIG. 11 is a perspective view of a liquid ejecting apparatus according to a second embodiment.

As illustrated in FIG. 11, a liquid ejecting apparatus 211 includes a substantially rectangular parallelepiped-shaped exterior covering 212. A cassette 216, a cassette (medium containing unit) 215, an output tray 218, and an operating panel 219 are disposed in this order from the bottom to the top in the exterior covering 212 (see, for example, FIGS. 11 and 13). The cassette 216 contains a mounting unit 214 on which trays (containers) 213 are removably mounted. The cassette 215 can contain media (not illustrated) such as sheets of printing paper. The media are output to the output tray 218. The liquid ejecting apparatus 211 is operable through the operating panel 219. The number of cassettes may be increased by disposing a different cassette 217 below the cassette 216 (see FIG. 12). The exterior covering 212 may include a front lid (not illustrated) through which the mounting unit 214 can be exposed. In this case, it is preferable that the front lid be pivotable.

Figure 12:
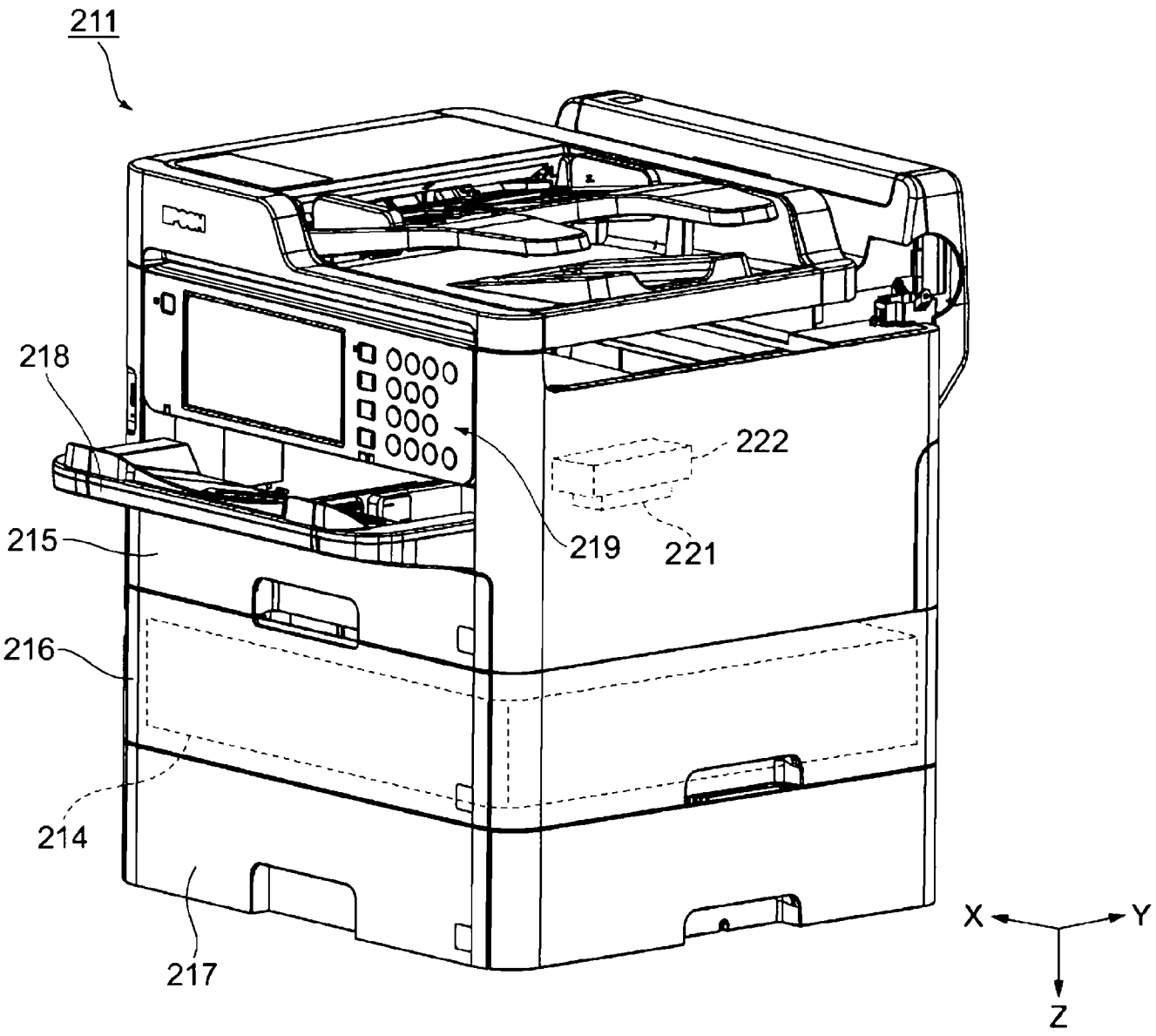
FIG. 12 is a perspective view of a printer in which the number of cassettes (medium containing units) is increased.

A liquid ejecting head 221 and a carriage 222 are provided in the exterior covering 212 (see FIGS. 11 and 12). The liquid ejecting head 221 ejects liquid from nozzles. The carriage 222 reciprocates in a scan direction being coincident with the width direction of the liquid ejecting apparatus 211. The liquid ejecting head 221 is moved together with the carriage 222 and ejects the liquid supplied from liquid supply members 220 toward the media. Thus, printing is performed on the media.

According to a second embodiment, the width direction is a direction intersecting (preferably, perpendicular to) a movement path for mounting the trays 213 on the mounting unit 214, and the depth direction is a direction in which the movement path extends. Also, the width direction and the depth direction substantially extend along a horizontal plane. In the drawings, the direction of gravity is represented by the Z axis and the direction in which the movement path for mounting the trays 213 on the mounting unit 214 extends is represented by the Y axis on the assumption that the exterior covering 212 is placed on the horizontal plane. The width direction is represented by the X axis perpendicular to the Z axis and the Y axis. The width direction, the direction of gravity, and the front/rear direction (a direction in which mounting on the mounting unit 214 is performed) intersect or, preferably, are perpendicular to one another and respectively used as the directions when the lengths of the width, height, and the depth are described.

Figure 13:
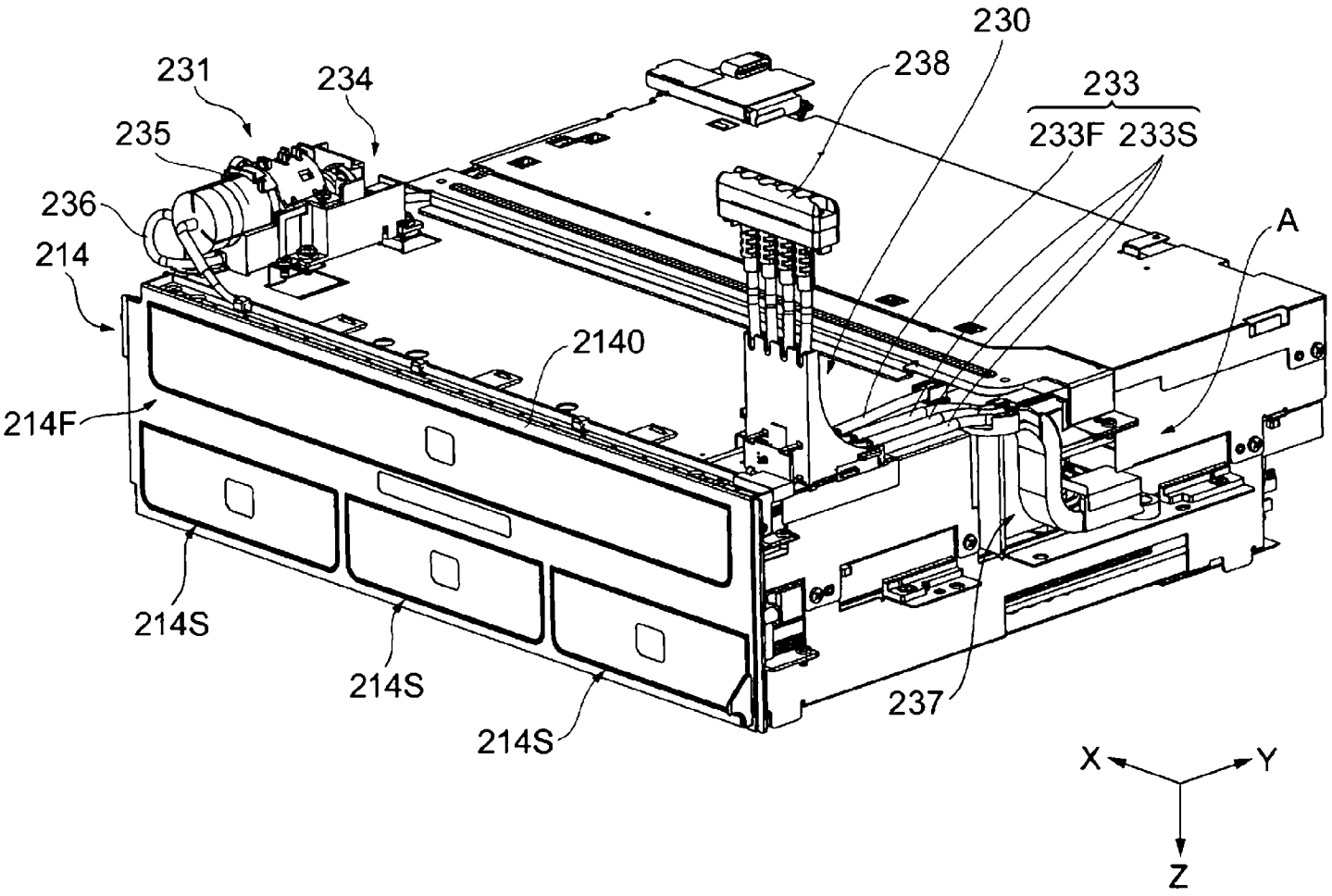
FIG. 13 is a perspective view of a mounting unit for liquid supply members when seen from front.
Figure 16:
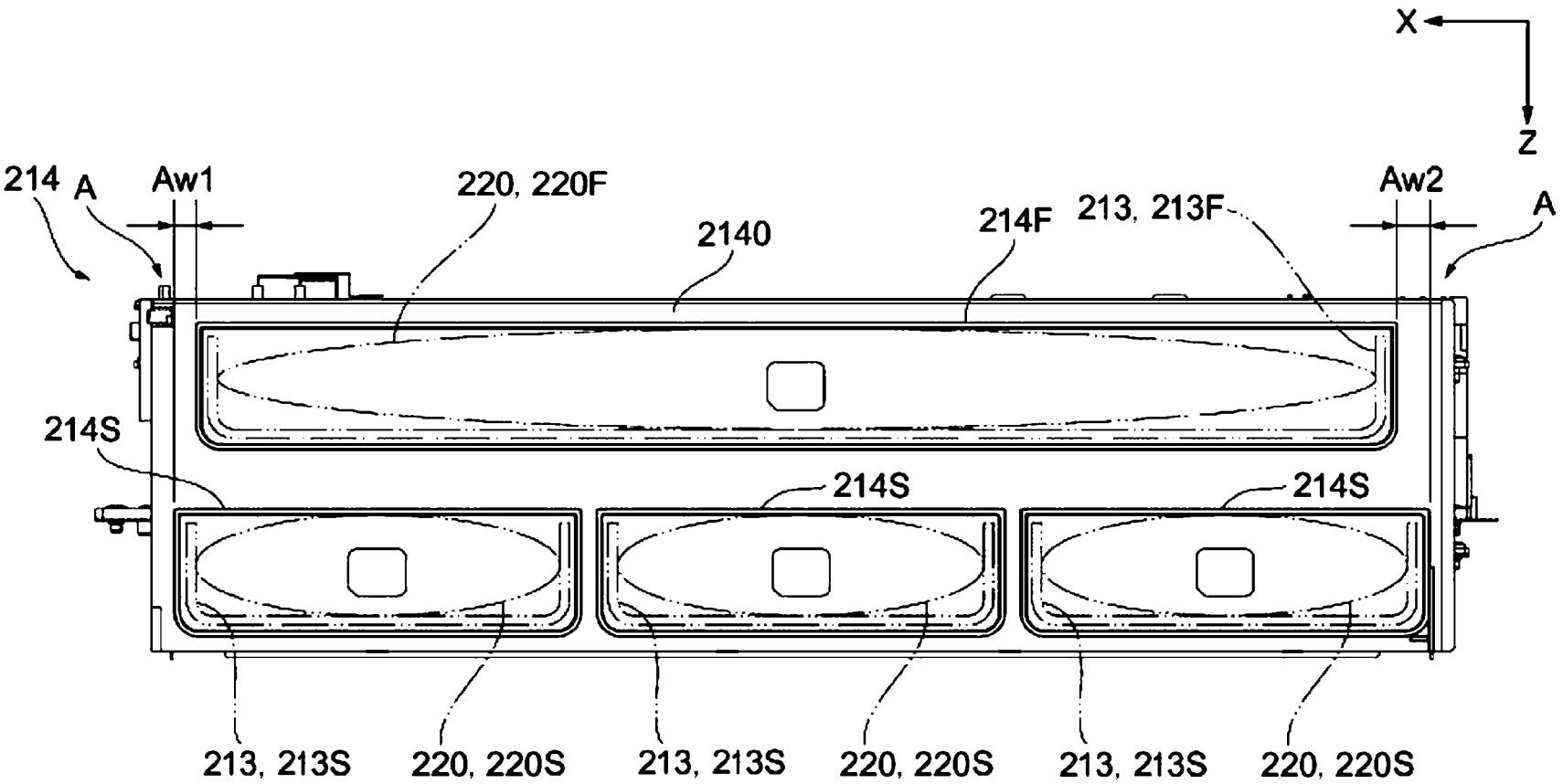
FIG. 16 is a front view of the mounting unit for the liquid supply members.

In the liquid ejecting apparatus 211 according to the present embodiment, the mounting unit 214 includes a first mounting portion 214F and second mounting portions 214S (see, for example, FIGS. 13 and 16). The first mounting portion 214F is formed in a bezel portion 2140. A first liquid supply member 220F is mounted in the first mounting portion 214F. A plurality of, for example, three of the second mounting portions 214S are disposed below the first mounting portion 214F in the Z direction such that a plurality of, for example, three of second liquid supply members 220S are mounted side-by-side therein in the horizontal direction (width direction). The first liquid supply member 220F having a larger width than the width of the second liquid supply members 220S can be mounted in the first mounting portion 214F (see FIG. 16).

The first liquid supply member 220F is mounted in the liquid ejecting apparatus 211 by removably mounting the first liquid supply member 220F on a first tray 213F and mounting the first tray 213F in the first mounting portion 214F. Likewise, the second liquid supply members 220S are mounted in the liquid ejecting apparatus 211 by removably mounting the second liquid supply members 220S on second trays 213S and mounting the second trays 213S in the second mounting portions 214S (see, for example, FIG. 16). These liquid supply members 220F, 220S are formed by bag-shaped members (ink packs) filled with liquid for, for example, printing. As illustrated in, for example, FIG. 16, the liquid supply members 220F, 220S are mounted on the respective trays 213F, 213S in respective horizontal positions in which the width is larger than the height (see FIG. 16). This can reduce the height of the mounting portions 214F, 214S.

The trays 213 are containers that are removably mountable in the mounting unit 214 with the liquid supply members 220 mounted thereon. The first tray 213F is a single tray having a comparatively large size and mounted in the first mounting portion 214F. The second trays 213S include, for example, three trays mounted in the second mounting portions 214S. As illustrated in, for example, FIG. 16, the width (length in the X direction) of the first tray 213F is larger than the width of the second trays 213S. These trays 213 can be repeatedly used and allow replacement of the liquid supply members 220.

Figure 14:
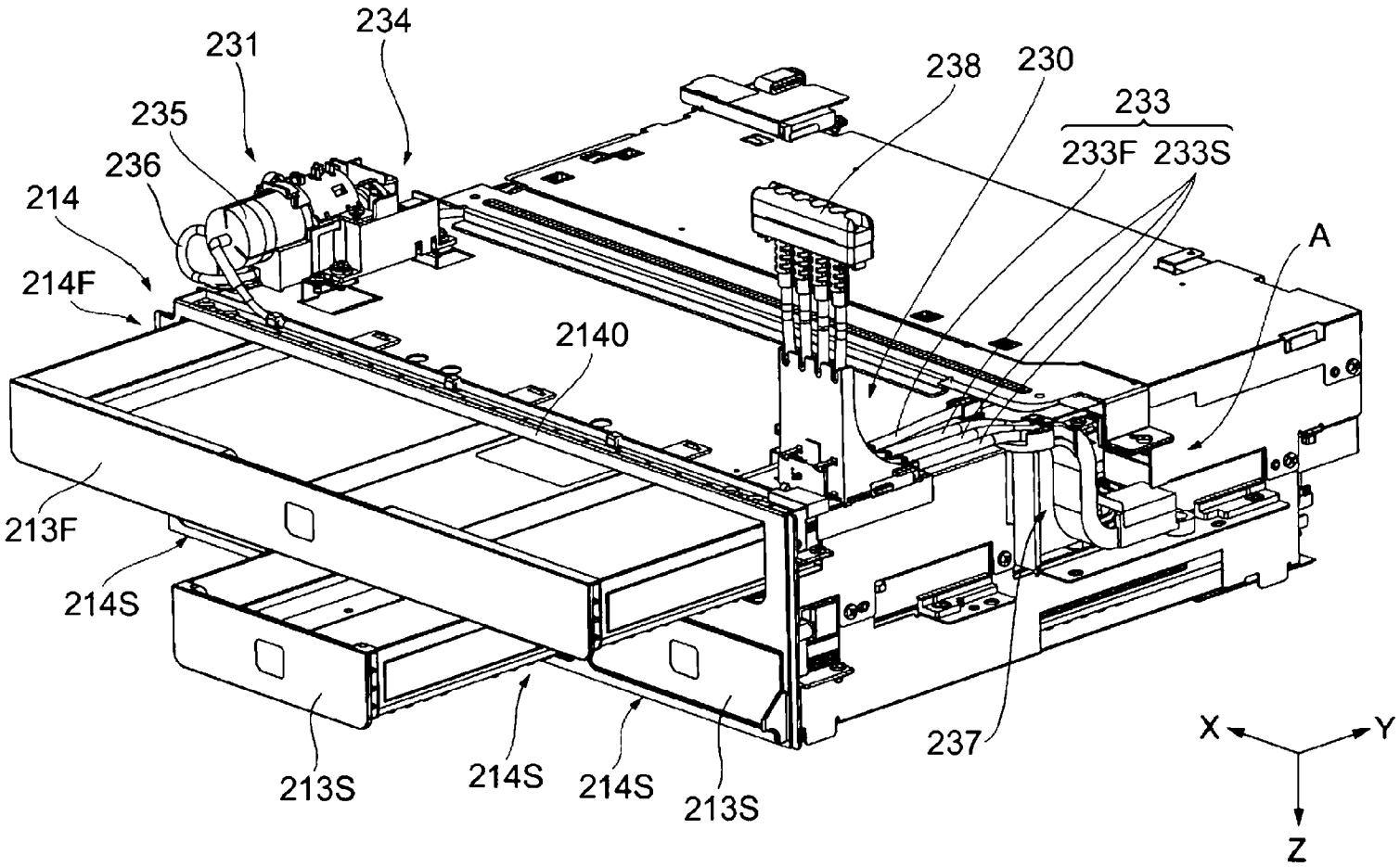
FIG. 14 is a perspective view seen from an upper front position, illustrating the mounting unit for the liquid supply members when ink pack trays of a first mounting portion and a central one of second mounting portions are pulled.

As described above, the mounting unit 214 includes the first mounting portion 214F in which the first liquid supply member 220F mounted on the first tray 213F is mounted and the plurality of second mounting portions 214S which are disposed below the first mounting portion 214F and in which the second liquid supply members 220S mounted on the second trays 213S are mounted. With this mounting unit 214, the likelihood of the liquid supply members 220 being damaged during operation such as mounting can be suppressed. More specifically, in the liquid ejecting apparatus 211 in which the liquid supply members 220 and their mounting portions 214 are arranged in two stages, that is, the upper and lower stages, when the upper tray is pulled forward and the user releases his or her hand from this upper tray while one of the lower trays are pulled forward in the Y-axis direction, the upper tray may become inclined. This may cause the upper tray to hit and give damage to the liquid supply member 220 on the lower tray being pulled. In contrast, in the case of the mounting unit 214 of the liquid ejecting apparatus 211 according to the present embodiment, even when the first tray 213F is pulled forward in the Y-axis direction, the user releases the hand from the first tray 213F, and the first tray 213F is inclined while one or more second trays 213S are pulled forward in the Y-axis direction, the bottom of the first tray 213F is brought into contact with the upper edges of the side walls or the front surface of the second tray 213S in the pulled state. Thus, the bottom of the first tray 213F does not reach the second liquid supply member 220S (see FIG. 14). That is, the side walls and so forth of the second trays 213S having a smaller width than the width of the first tray 213F function as a stopper or a guard. This can prevent the liquid supply members mounted on the lower stage (that is, the second liquid supply members 220S mounted on the second trays 213S) from being damaged, or further, being flattened by being struck by the first tray 213F.

In the mounting unit 214 of the liquid ejecting apparatus 211 according to the present embodiment, side regions A are provided in regions above the second mounting portions 214S and outside the first mounting portion 214F in the width direction (X direction) (see FIG. 16). As illustrated in, for example, FIG. 16, the width of the first mounting portion 214F is smaller than the entire width of a region including three of the second mounting portions 214S, and spaces as the side regions A are formed outside the first mounting portion 214F corresponding to the difference between the widths. In other words, the side regions A are spaces inside comparatively thick wall portions near respective sides of the first mounting portion 214F. According to the present embodiment, a total of two side regions A are provided at respective side positions between which the first mounting portion 214F is interposed (see FIG. 16). In one of the side regions A on one side, one side portion of the first mounting portion 214F is positioned further to the inside by a width Aw1 than a side portion of one of the second mounting portions 214S below the one side portion of the first mounting portion 214F, and in the other side region A on the other side, the other side portion of the first mounting portion 214F is positioned further to the inside by a width Aw2 than a side portion of one of the second mounting portions 214S below the other side portion of the first mounting portion 214F (see FIG. 16). Both of the spaces as the side regions A on both sides have a depth the length of which is, in the depth direction (Y direction), about the same as the length of the first tray 213F mounted in the first mounting portion 214F.

Figure 15:
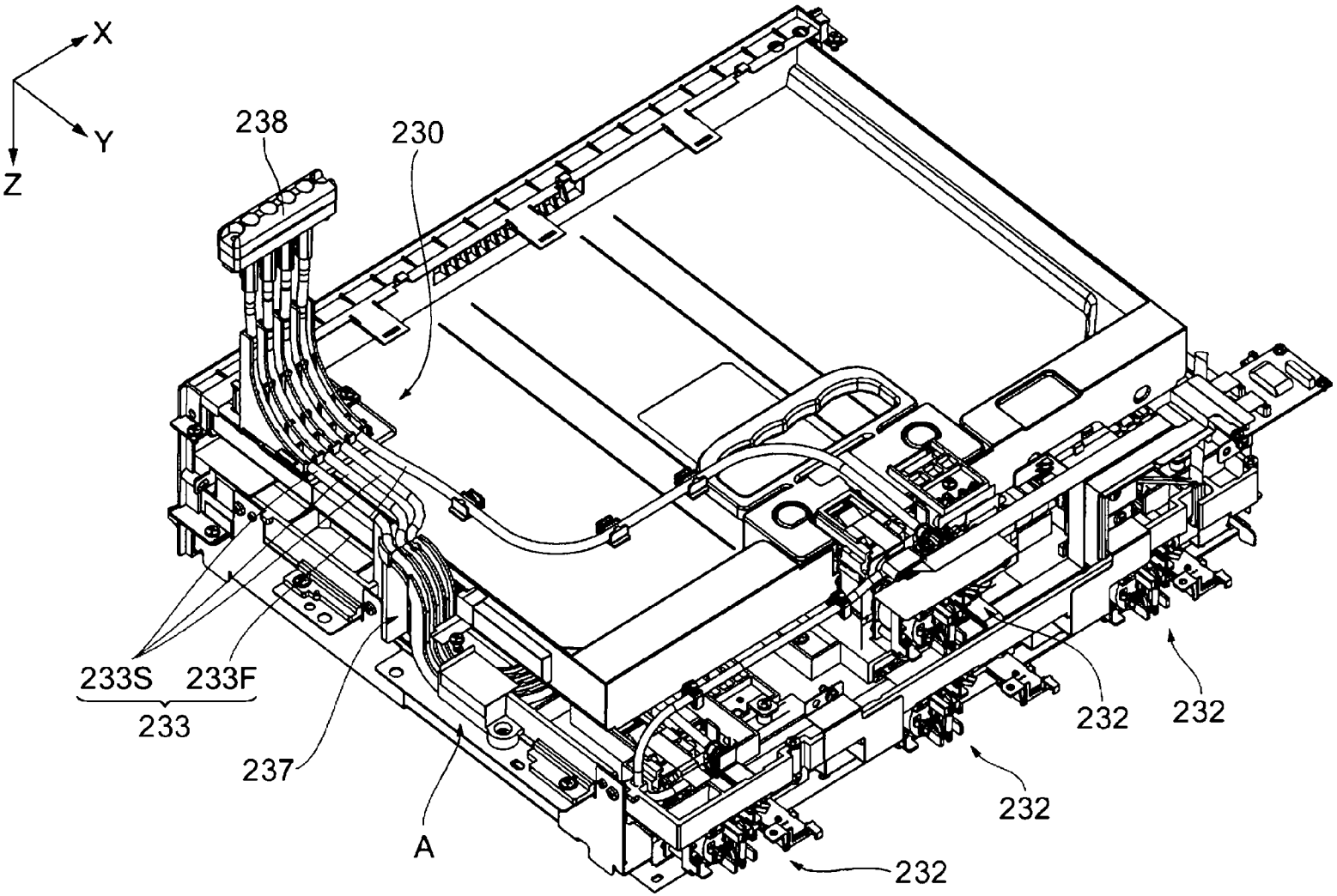
FIG. 15 is a perspective view of the mounting unit for the liquid supply members when seen from rear.

The space can be effectively used by laying out other elements of the liquid ejecting apparatus 211 in the side regions A. For example, a plurality of supply channels 230 for the liquid are provided according to the present embodiment, and at least part of each of some of the supply channels 230 passes through one of the side regions A (see FIGS. 14 and 15). Here, "at least part of each of the supply channels 230" refers to a portion of the supply channel 230 that is secured and not moving. For example, as will be described, a redirecting portion 237 of the supply channel 230 disposed in and secured at the side region A is "at least part of each of the supply channels 230".

The liquid is supplied from the first mounting portion 214F and the second mounting portions 214S toward the liquid ejecting head 221 through the supply channels 230. Each of the supply channels 230 is provided for a corresponding one of the types (colors according to the present embodiment) of the liquid. FIG. 13 and after illustrate connecting portions 232 being upstream ends to which the liquid supply members 220 are connected, flexible supply tubes 233, and a coupling unit 238 provided at downstream ends of the supply tubes 233. In addition to these, although they are not illustrated, downstream supply channels that allow communication from the coupling unit 238 to the liquid ejecting head 221 are provided. The supply channels 230 according to the present embodiment include a first supply tube 233F and second supply tubes 233S. The liquid in the first liquid supply member 220F mounted in the first mounting portion 214F is supplied to the liquid ejecting head 221 through a single first supply tube 233F. The liquid in the second liquid supply members 220S mounted in the second mounting portions 214S is supplied to the liquid ejecting head 221 through three of the second supply tubes 233S (see FIGS. 14 and 15). The coupling unit 238 can be removably connected to the downstream supply channels and is disposed on the front side of the liquid ejecting apparatus 211 in the Y direction (see, for example, FIG. 15).

Furthermore, the redirecting portions 237 are formed in the supply channels 230. The redirecting portions 237 redirect from the horizontal direction to the vertical direction the direction in which the liquid flows in one of the side regions A (see FIGS. 13 to 15). According to the present embodiment, the redirecting portions 237 are disposed in only one of two side regions A. This allows the other side region A to be allocated to another use. The redirecting portions 237 are disposed, for example, near the center of the side region A in the depth direction (Y direction). According to the present embodiment, three of the second supply tubes 233S are horizontally routed between the first mounting portion 214F and the second mounting portions 214S, and the redirecting portions 237 of the second supply tubes 233S are gathered. Then, the second supply tubes 233S are redirected from the horizontal direction to the vertical direction at the redirecting portions 237 arranged in the width direction (X direction). In other words, the side region A is formed as a space that allows the second supply tubes 233S, which correspond in number to the second liquid supply members 220S mounted in the second mounting portions 214S, to be arranged in the width direction. A guide for redirecting the second supply tubes 233S from the horizontal direction to the vertical direction may be provided in the side region A.

As has been described, with the redirecting portions 237 disposed in the side region A, tubes can be routed without an increase in the footprint of the apparatus while increasing the capacity of the liquid. In a form in which two redirecting portions 237 are formed in each of the second supply tubes 233S, the redirecting portions 237 may be disposed in two side regions A.

Pump chambers (not illustrated) are provided between the connecting portions 232 and the supply tubes 233. Downstream ends of the connecting portions 232 and upstream ends of the supply tubes 233 are communicated with the pump chambers. The pump chambers are separated from pressure varying chambers (not illustrated) with flexible films (not illustrated) interposed therebetween.

The liquid contained in the liquid supply members 220 is fed to the supply channels 230 by a supply mechanism 231.

The supply mechanism 231 includes, for example, a pressure varying mechanism 234, a drive source (for example, a motor) 235 for the pressure varying mechanism 234, and a pressure varying channel 236 that connects the pressure varying mechanism 234 to the pressure varying chambers. When the drive source 235 is driven, the pressure varying mechanism 234 depressurizes the pressure varying chambers through the pressure varying channel 236. This causes the flexible films to be bent toward the pressure varying chambers, thereby reducing the pressure of the pump chambers. Due to the reduction in the pressure of the pump chambers, the liquid contained in the liquid supply members 220 is sucked into the pump chambers through the connecting portions 232. Then, when the pressure varying mechanism 234 cancels the depressurization of the pressure varying chambers through the pressure varying channel 236, the flexible films is bent toward the pump chambers, thereby increasing the pressure of the pump chambers. As a result, due to the increase in the pressure of the pump chambers, the liquid in the pump chambers flows out into the supply tubes 233 while being pressurized. The supply mechanism 231 alternately performs suction and discharge repeatedly, thereby supplying the liquid from the liquid supply members 220 to the liquid ejecting head 221.

As has been described, with the liquid ejecting apparatus 211 according to the present embodiment, the first liquid supply member 220F mounted in the first mounting portion 214F and the second liquid supply members 220S mounted in the second mounting portions 214S can be arranged in the up-down direction. Thus, the capacity of the liquid supply members 220 can be increased without the increase in the footprint of the apparatus. Accordingly, the capacity of a color an increase of which is desired (for example, black) can be comparatively easily increased.

The embodiments having been described are intended to facilitate understanding of the invention and not to interpret the invention in a limited manner. The elements included in the embodiments and arrangement, materials, conditions, shapes, sizes, and so forth of the elements are not limited to those of the exemplified elements and can be appropriately changed. Furthermore, structures described in the different embodiments can be partially replaced or combined with one another.

Figure 17:
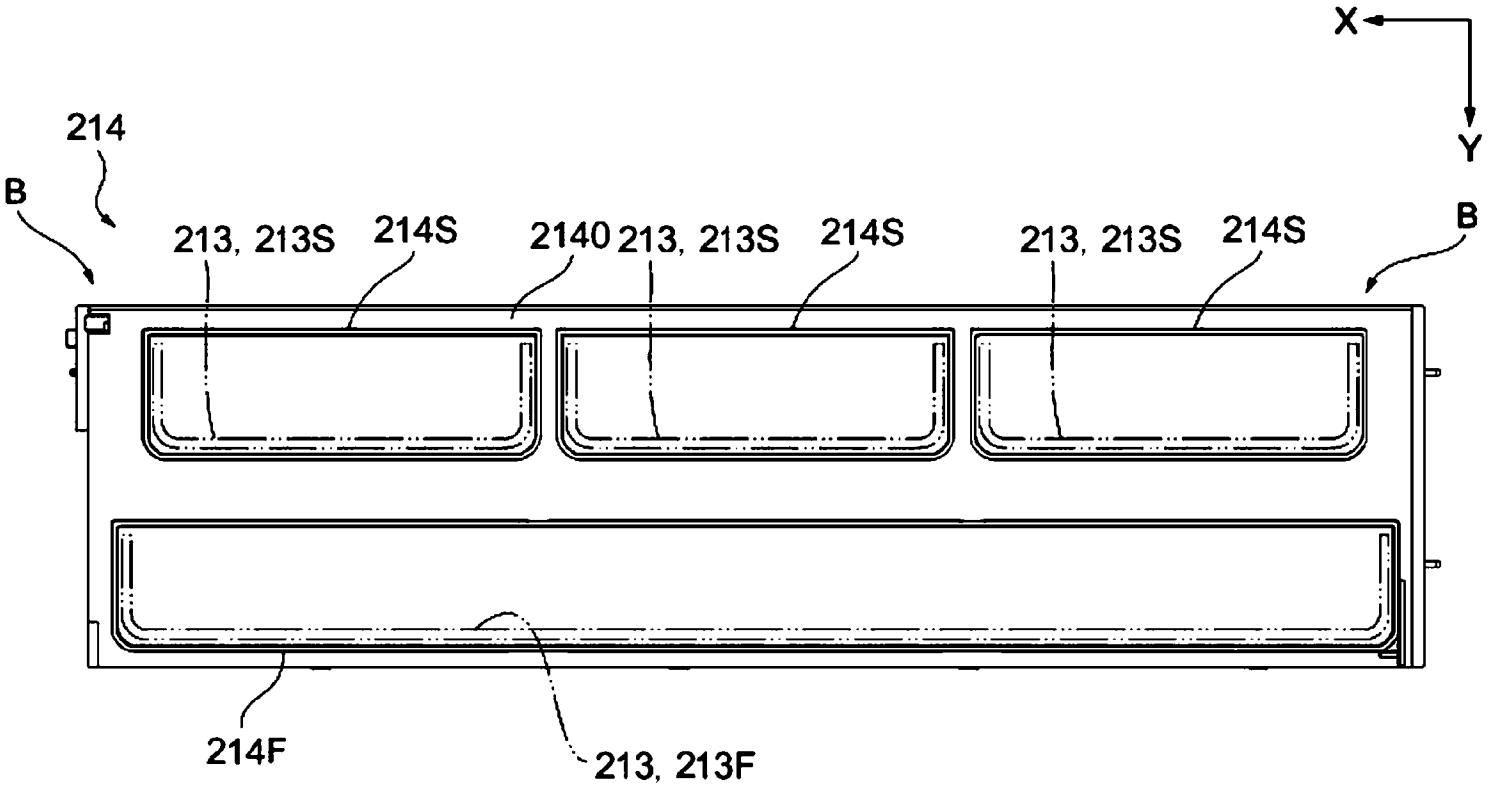
FIG. 17 is a front view of a different form of the mounting unit for the liquid supply members.

In the mounting unit 214 of the liquid ejecting apparatus 211, the first mounting portion 214F may be disposed below the second mounting portions 214S (see FIG. 17). In this case, the width of the first tray 213F (or the first liquid supply member 220F) mounted in the first mounting portion 214F may be larger than or equal to the entire width of a region including a plurality of, for example, three of the second trays 213S (or the second liquid supply members 220S) mounted in the second mounting portions 214S. In FIG. 17, side regions formed outside the second mounting portions 214S in the width direction (X direction) are denoted by sign B.

In the liquid ejecting apparatus 211, the cassette (medium containing unit) 215 may be disposed such that the cassette 215 and the first mounting portion 214F are arranged in the vertical direction and the cassette 215 is positioned above the first mounting portion 214F. Alternatively, the cassette 215 may be disposed such that the cassette 215 and the second mounting portions 214S are arranged in the vertical direction and the cassette 215 is positioned below the second mounting portions 214S. Alternatively, cassettes 215 are provided at both the above-described positions (see FIG. 12).

When a plurality of medium containing units that respectively contain the media of different sizes are provided, it is preferable that the medium containing unit that contains the media of a smallest size be disposed above the mounting unit 214. In such a case, spaces can be obtained on both sides of the medium containing unit. This facilitates the layout of other elements.

Technical ideas and operational effects understood from the above-described embodiments are described below.

Idea 1

A liquid ejecting apparatus includes a liquid ejecting head and a mounting unit. The liquid ejecting head is able to eject liquid. A plurality of liquid containers containing the liquid to be supplied to the liquid ejecting head are mounted so as to overlap in an up-down direction. The mounting unit includes a separator and an electrical member. The separator separates, in the up-down direction, a space where the plurality of liquid containers are mounted. The electrical member allows electricity to flow therethrough. The separator has a through portion that penetrates through the separator in the up-down direction. The through portion is positioned such that, when seen in the up-down direction, an edge portion of the through portion does not overlap with the electrical member positioned below the through portion.

When the liquid leaks from above the separator, this liquid flows down on the separator. The liquid leaking on the separator drops through the through portion. At this time, the liquid drops along the edge portion of the through portion. It is not preferable that, when the liquid drops, the liquid adhere to the electrical member through which electricity flows. In this regard, according to the above-described embodiment, the edge portion of the through portion does not overlap with the electrical member positioned below the through portion when seen in the up-down direction. This can reduce the likelihood of the liquid that drops from the through portion adhering to the electrical member. Accordingly, the likelihood of failures occurring due to the liquid having leaked can be reduced.

Idea 2

In the liquid ejecting apparatus according to Idea 1, the through portion is positioned such that, when seen in the up-down direction, the through portion does not overlap with the electrical member.

With this structure, when seen in the up-down direction, the through portion is disposed at a different position from the position of the electrical member disposed below the through portion. This can further reduce the likelihood of the liquid that drops from the through portion adhering to any of the electrical member.

Idea 3

In the liquid ejecting apparatus according to Idea 1 or 2, the mounting unit includes a plurality of connecting portions to which the plurality of liquid containers mounted in the mounting unit are respectively connected. In this case, the plurality of connecting portions allow the liquid to be supplied from the plurality of liquid containers connected thereto toward the liquid ejecting head. Also in the liquid ejecting apparatus according to Idea 1 or 2, the through portion is positioned such that, when seen in the up-down direction, the edge portion of the through portion does not overlap with any of the plurality of connecting portions positioned below the through portion.

When the plurality of liquid containers mounted in the mounting unit are connected to the plurality of connecting portions, the liquid is supplied from the plurality of liquid containers to the liquid ejecting head through the plurality of connecting portions. In the mounting unit in which the plurality of liquid containers can be mounted, the plurality of different liquid containers containing different types of the liquid may be mounted. In this case, when the liquid that drops from the through portion adheres to any of the plurality of connecting portions positioned below the through portion, different types of the liquid may be mixed with each other. In this regard, with the above-described structure, the edge portion of the through portion does not overlap with any of the plurality of connecting portions positioned below the through portion when seen in the up-down direction. This can reduce the likelihood of the liquid that drops from the through portion adhering to any of the plurality of connecting portions.

Idea 4

In the liquid ejecting apparatus according to Idea 3, the through portion is positioned such that, when seen in the up-down direction, the through portion does not overlap with any of the plurality of connecting portions positioned below the through portion.

With this structure, when seen in the up-down direction, the through portion is disposed at a different position from the position of any of the plurality of connecting portions disposed below the through portion. This can further reduce the likelihood of the liquid that drops from the through portion adhering to any of the plurality of connecting portions.

Idea 5

In the liquid ejecting apparatus according to any one of Ideas 1 to 4, the separator has a groove extending toward the through portion.

With this structure, when the liquid leaks to the separator, this liquid flows into the groove. Thus, the liquid can be guided toward the through portion.

Idea 6

In the liquid ejecting apparatus according to any one of Ideas 1 to 5, the separator has an inclined portion downwardly inclined toward the through portion.

With this structure, when the liquid leaks to the separator, this liquid flows along the inclined portion. Thus, the liquid can be guided toward the through portion.

Idea 7

The liquid ejecting apparatus according to any one of Ideas 1 to 6 further includes a detection unit that is disposed below the mounting unit and that includes a detector which is able to detect adhering of the liquid.

This structure allows the detector to detect the liquid having leaked. Accordingly, the user can be notified of leakage of the liquid.

Idea 8

In the liquid ejecting apparatus according to Idea 7, the detection unit includes a guide portion that is in contact with the detector and that is positioned such that, when seen in the up-down direction, part of the guide portion overlaps with the edge portion of the through portion.

With this structure, the guide portion guides the liquid having dropped from the through portion to the detectors. Thus, the liquid having leaked can be quickly detected.

Idea 9

In the liquid ejecting apparatus according to Idea 8, the guide portion includes an absorbing member that is able to absorb the liquid.

With this structure, the liquid having dropped from the through portion is guided to the detector by being absorbed by the absorbing member. Thus, the liquid having leaked can be quickly detected.

Idea 10

A liquid ejecting apparatus includes a liquid ejecting head, a first mounting portion, and a second mounting portion. The liquid ejecting head ejects liquid supplied from a first liquid supply member and second liquid supply members. The first liquid supply member is mounted in the first mounting portion. The second mounting portion is disposed above or below the first mounting portion, and the second liquid supply members are mounted in the second mounting portion such that the second liquid supply members are horizontally arranged. When a direction in which the second liquid supply members are arranged is a width direction, and a length of the first liquid supply member in the width direction and a length of each of the second liquid supply members in the width direction are a width, the width of the first supply member is larger than the width of the second liquid supply member.

In this form, the first liquid supply member mounted in the first mounting portion is disposed below or above the second liquid supply members mounted in the second mounting portion. Thus, the capacity of the liquid supply members can be increased without an increase in the footprint of the apparatus. Accordingly, the capacity of a color an increase of which is desired can be easily increased.

Idea 11

In the liquid ejecting apparatus according to Idea 10, the second mounting portion is disposed below the first mounting portion.

In this form, in the case of a tray method in which the liquid supply members mounted on trays are pushed into/pulled from the mounting portions, the second mounting portion in which a plurality of second liquid supply members are horizontally arranged is disposed at the lower position. Thus, the liquid supply members are prevented from being damaged.

Idea 12

In the liquid ejecting apparatus according to Idea 10 or 11, the width of the first liquid supply member is larger than a height of the first liquid supply member in a position in which the first liquid supply member is mounted in the first mounting portion. Also in the liquid ejecting apparatus according to Idea 10 or 11, the width of the second liquid supply member is larger than a height of the second liquid supply member in a position in which the second liquid supply member is mounted in the second mounting portion.

In this form, the height of the mounting portions can be reduced. Thus, even when the mounting portions are stacked one on top of another, the height of the entirety of the liquid ejecting apparatus can be reduced.

Idea 13

In the liquid ejecting apparatus according to Idea 11, at least one side region is provided at a position above the second mounting portion and outside, in the width direction, the first mounting portion.

In this form, the at least one side region can be effectively used. For example, another element may be disposed in the at least one side region.

Idea 14

In the liquid ejecting apparatus according to Idea 13, a supply channel through which the liquid is supplied from the second mounting portion toward the liquid ejecting head is provided and at least part of the supply channel passes through the at least one side region.

In this form, a tube can be routed without an increase in the footprint of the apparatus while increasing the capacity of the liquid supply members.

Idea 15

In the liquid ejecting apparatus according to Idea 13 or 14, a supply channel through which the liquid is supplied from the second mounting portion toward the liquid ejecting head is provided. Also in the liquid ejecting apparatus according to Idea 13 or 14, the supply channel has, in the at least one side region, a redirecting portion that redirects a direction in which the liquid flows from a horizontal direction to a vertical direction.

In this form, a tube can be routed without an increase in the footprint of the apparatus while increasing the capacity of the liquid supply members.

Idea 16

In the liquid ejecting apparatus according to Idea 15, the at least one side region includes two side regions disposed on both sides of the first mounting portion. In this case, the redirecting portion is disposed at least one of the two side regions.

In this form, when there is a side region where the redirecting portion is not disposed, this side region can be allocated to another use.

Idea 17

The liquid ejecting apparatus according to any one of Ideas 10 to 16 further includes a plurality of containers that are removably mounted in the first mounting portion and the second mounting portion. In this case, the first liquid supply member and the second liquid supply members are mounted in the first mounting portion and the second mounting portion while being held in the plurality of containers.

In this form, the first liquid supply member and the second liquid supply members can be replaced by repeatedly using the containers.

The entire disclosure of Japanese Patent Application No. 2017-212825, filed Nov. 2, 2017 and Japanese Patent Application No. 2017-203534, filed Oct. 20, 2017 and Japanese Patent Application No. 2018-054308, filed Mar. 22, 2018 are expressly incorporated by reference herein.

What is claimed is:

1. A liquid ejecting apparatus comprising:

a liquid ejecting head configured to eject liquid; and a mounting unit in which a plurality of liquid containers containing the liquid to be supplied to the liquid ejecting head are mounted so as to overlap in an up-down direction, wherein the mounting unit includes:

a separator that separates, in the up-down direction, a space where the plurality of liquid containers are mounted, an electrical member that allows electricity to flow therethrough, a detection unit that is disposed below the mounting unit and that includes a detector which is able to detect adhering of the liquid, and a plurality of connecting portions to which the plurality of liquid containers detachably mounted in the mounting unit are respectively connected, wherein the separator has a through portion that penetrates through the separator in the up-down direction, wherein the through portion is positioned such that, when seen in the up-down direction, an edge portion of the through portion does not overlap with the electrical member and the connecting portion positioned below the through portion, and wherein the detection unit includes a guide portion that is in contact with the detector and that is positioned such that, when seen in the up-down direction, part of the guide portion overlaps with the edge portion of the through portion.

2. The liquid ejecting apparatus according to claim 1, wherein the through portion is positioned such that, when seen in the up-down direction, the through portion does not overlap with the electrical member.

3. The liquid ejecting apparatus according to claim 1, wherein the through portion is positioned such that, when seen in the up-down direction, the through portion does not overlap with any of the plurality of connecting portions positioned below the through portion.

4. The liquid ejecting apparatus according to claim 1, wherein the separator has a groove extending toward the through portion.

5. The liquid ejecting apparatus according to claim 1, wherein the separator has an inclined portion downwardly inclined toward the through portion.

6. The liquid ejecting apparatus according to claim 1, wherein the guide portion includes an absorbing member that is able to absorb the liquid.

7. A liquid ejecting apparatus comprising:

a liquid ejecting head configured to eject liquid;

a mounting unit in which a plurality of liquid containers containing the liquid to be supplied to the liquid ejecting head are mounted so as to overlap in an up-down direction; and a detection unit that is disposed below the mounting unit and that includes a detector which is configured to detect adhering of the liquid, wherein the mounting unit includes:

a separator that separates, in the up-down direction, a space where the plurality of liquid containers are mounted, and an electrical member that allows electricity to flow therethrough, wherein the separator has a through portion that penetrates through the separator in the up-down direction, wherein the through portion is positioned such that, when seen in the up-down direction, an edge portion of the through portion does not overlap with the electrical member positioned below the through portion, wherein the detection unit includes a guide portion that is in contact with the detector and that is positioned such that, when seen in the up-down direction, part of the guide portion overlaps with the edge portion of the through portion.

8. A liquid ejecting apparatus comprising:

a liquid ejecting head configured to eject liquid;

a mounting unit in which a plurality of liquid containers containing the liquid to be supplied to the liquid ejecting head are mounted so as to overlap in an up-down direction; and a detection unit that is disposed below the mounting unit and that includes a detector which is configured to detect adhering of the liquid, wherein the mounting unit includes a separator that separates, in the up-down direction, a space where the plurality of liquid containers are mounted, the separator having a through portion that penetrates through the separator in the up-down direction, wherein the through portion is positioned such that, when seen in the up-down direction, an edge portion of the through portion overlaps with a guide portion for guiding the liquid to the detector.

9. The liquid ejecting apparatus according to claim 8, wherein the guide portion includes at least one of an absorbing member for absorbing the liquid and a groove.

* * * * *